US010811026B2

(12) United States Patent
Sugiyama

(10) Patent No.: US 10,811,026 B2
(45) Date of Patent: Oct. 20, 2020

(54) NOISE SUPPRESSION METHOD, DEVICE, AND PROGRAM

(75) Inventor: Akihiko Sugiyama, Tokyo (JP)

(73) Assignee: NEC CORPORATION, Tokyo (JP)

( * ) Notice: Subject to any disclaimer, the term of this patent is extended or adjusted under 35 U.S.C. 154(b) by 825 days.

(21) Appl. No.: 12/307,542

(22) PCT Filed: Jun. 29, 2007

(86) PCT No.: PCT/JP2007/063093

§ 371 (c)(1),
(2), (4) Date: Jan. 5, 2009

(87) PCT Pub. No.: WO2008/004499

PCT Pub. Date: Jan. 10, 2008

(65) Prior Publication Data

US 2009/0296958 A1 Dec. 3, 2009

(30) Foreign Application Priority Data

Jul. 3, 2006 (JP) ..... 2006-183776

(51) Int. Cl.
*G10L 21/02* (2013.01)
*G10L 21/0208* (2013.01)
*G10L 21/0216* (2013.01)

(52) U.S. Cl.
CPC ..... *G10L 21/02* (2013.01); *G10L 21/0208* (2013.01); *G10L 2021/02166* (2013.01)

(58) Field of Classification Search
CPC ..... G10L 21/0208; G10L 21/02; G10L 2021/02082; G10L 25/27; G10L 25/03885; G10L 25/0226; G10L 25/0228; G10L 25/0232; G10L 25/356; G10L 25/407; G10L 25/48; G10L 25/505; G10L 27/01; G10L 2021/02166; H04R 25/407; H04R 25/48; H04R 25/505; H03M 1/0626; H04S 3/00; H04M 9/085
USPC ..... 381/92, 94.1–94.3, 98, 320, 317
See application file for complete search history.

(56) References Cited

U.S. PATENT DOCUMENTS

| | | | | |
|---|---|---|---|---|
| 4,811,404 | A | 3/1989 | Vilmur et al. | |
| 2002/0064287 | A1* | 5/2002 | Kawamura | H04R 1/406 381/92 |
| 2003/0028372 | A1* | 2/2003 | McArthur et al. | 704/220 |
| 2003/0177007 | A1 | 9/2003 | Kanazawa et al. | |

(Continued)

FOREIGN PATENT DOCUMENTS

| | | | |
|---|---|---|---|
| JP | 1988007023 | A | 1/1988 |
| JP | H03500347 | A | 1/1991 |

(Continued)

OTHER PUBLICATIONS

International Search Report for PCT/JP2007/063093 dated Oct. 9, 2007.

(Continued)

*Primary Examiner* — Ping Lee

(57) ABSTRACT

It is possible to provide a noise suppression method, device, and program capable of realizing a sound image positioning of an output side corresponding to an input side with a small calculation amount. The device includes a common suppression coefficient calculation unit for receiving conversion outputs from a plurality of channels and calculating a suppression coefficient common to the channels.

4 Claims, 16 Drawing Sheets

(56) References Cited

U.S. PATENT DOCUMENTS

| | | | | |
|---|---|---|---|---|
| 2004/0213420 | A1* | 10/2004 | Gundry | H03G 7/004 381/104 |
| 2005/0152563 | A1 | 7/2005 | Amada et al. | |
| 2005/0195995 | A1* | 9/2005 | Baumgarte | H03G 5/165 381/104 |
| 2006/0210096 | A1* | 9/2006 | Stokes, III | H03G 3/301 381/107 |
| 2007/0291960 | A1* | 12/2007 | Sekiguchi | H03G 3/301 381/107 |

FOREIGN PATENT DOCUMENTS

| | | | |
|---|---|---|---|
| JP | 1994334534 | A | 12/1994 |
| JP | 2001344000 | A | 12/2001 |
| JP | 2002073066 | A | 3/2002 |
| JP | 2002204175 | A | 7/2002 |
| JP | 2002236500 | A | 8/2002 |
| JP | 2002258897 | A | 9/2002 |
| JP | 2003514264 | A | 4/2003 |
| JP | 2003271191 | A | 9/2003 |
| JP | 2004078021 | A | 3/2004 |
| JP | 2005195955 | A | 7/2005 |
| JP | 2005202222 | A | 7/2005 |
| JP | 2006113515 | A | 4/2006 |

OTHER PUBLICATIONS

Masanori Kato et al., "A Low-Complexity Noise Suppressor with Nonuniform Subbands and a Frequency-Domain Highpass Filter", Media and Information Research Labs, NEC Corporation, ICASSP 2006, pp. 473-476.

Yariv Ephraim et al., "Speech Enhancement Using a Minimum Mean-Square Error Short-Time Spectral Amplitude Estimator", IEEE Transactions on Acoustics, Speech, and Signal Processing, vol. ASSP-32, No. 6, Dec. 1984, pp. 1109-1121.

"Mathmatics Dictionary", Iwanami Shoten Publishers, 1985, definition 374.

Jae S. Lim et al., "Enhancement and Bandwidth Compression of Noisy Speech", Proceedings of the IEEE, vol. 67, No. 12, Dec. 1979, pp. 1586-1604.

Steven F. Boll, "Suppression of Acoustic Noise in Speech Using Spectral Subtraction", IEEE Transactions of Acoustics, Speech, and Signal Processing, vol. ASSP-27, No. 2, Apr. 1979, pp. 113-120.

Japanese Office Action for JP2008-523665 dated May 30, 2012, 2 pages.

J.S. Lim et al., "Enhancement and bandwidth compression of noisy speech," Procs. of IEEE, vol. 67, No. 12, Dec. 1979.

* cited by examiner

NOISE SUPPRESSION METHOD, DEVICE, AND PROGRAM

This application is the National Phase of PCT/J2007/063093, filed Jun. 29, 2007, which claims priority to Japanese Application No. 2006-183776, filed Jul. 3, 2006.

APPLICABLE FIELD IN THE INDUSTRY

The present invention relates to a noise suppression method and device for suppressing noise superposed upon a desired sound signal, and more particularly to a multi-channel noise suppression method and device for suppressing components other than a desired signal that are included in a multi-channel signal sound-collected by a plurality of microphones arranged in different positions of a common acoustic space, and a program therefor.

BACKGROUND ART

A noise suppressor (noise suppression system), which is a system for suppressing noise superposed upon a desired sound signal, operates, as a rule, so as to suppress the noise coexisting in the desired sound signal by employing an input signal converted in a frequency region, thereby to estimate a power spectrum of a noise component, and subtracting this estimated power spectrum from the input signal. Successively estimating the power spectrum of the noise component enables the noise suppressor to be applied also for the suppression of non-constant noise. There exists, for example, the technique described in Patent document 1 as a noise suppressor.

In addition hereto, there exists the technique described in Non-patent document 1 as a technique realizing a reduction in an arithmetic quantity.

These techniques are identical to each other in a basic operation. That is, the above technique is for converting the input signal into a frequency region with a linear transform, extracting an amplitude component, and calculating a suppression coefficient frequency component by frequency component. Combining a product of the above suppression coefficient and amplitude in each frequency component, and a phase of each frequency component, and subjecting it to an inverse conversion allows a noise-suppressed output to be obtained. At this time, the suppression coefficient is a value ranging from zero to one (1), the output is completely suppressed, namely, the output is zero when the suppression coefficient is zero, and the input is outputted as it stands without suppression when the suppression coefficient is one (1).

In a situation where a plurality of microphones are installed in one acoustic space, for example, like the case of a multi-channel remote conference, conventionally, the input signal being obtained by each microphone is noise-suppressed by employing the noise suppressor channel by channel. A configuration of the noise suppressor in such a case is shown in FIG. 26. FIG. 26 shows an example of a three-channel case, and a degraded sound signal (signal in which the desired sound signal and the noise coexist) is supplied as a sample value sequence to input terminals 1, 7, and 13 from three microphones arranged in spatially different positions, respectively.

The degraded sound signal sample, which is subjected to the conversion such as a Fourier transform in a conversion unit 2, is divided into a plurality of frequency components, and the power spectrum obtained by employing an amplitude value thereof is multiplexed, and is supplied to a suppression coefficient calculation unit 6 and a multiplier 5. The phase is conveyed to an inverse Fourier transform unit 3. The suppression coefficient calculation unit 6 generates the suppression coefficient, by which the degraded sound is multiplied for a purpose of obtaining a noise-suppressed emphasized sound, for each of a plurality of the frequency components. The minimum square average short-time spectrum amplitude technique of minimizing the square average of the powers of the emphasized sounds is widely employed as one example of generating the noise suppression coefficient, and its details are described in the Patent document 1. The suppression coefficient generated frequency by frequency is supplied to the multiplier 5. The multiplier 5 multiplies the degraded sound supplied from the conversion unit 2 by the suppression coefficient supplied from the suppression coefficient calculation unit 6 frequency by frequency, and conveys its product as a power spectrum of the emphasized sound to the inverse conversion unit 3. The inverse conversion unit 3 matches the phase of the emphasized sound power spectrum supplied from the multiplier 5 to that of the degraded sound supplied from the conversion unit 2, performs the inverse conversion, and supplies it as an emphasized sound signal sample to an output terminal 4. While an example employing the power spectrum in the process so far was explained, it is widely known that the amplitude value equivalent to a square root thereof can be employed instead of it. The similar process is performed in an input terminal 7, a conversion unit 8, a suppression coefficient calculation unit 12, a multiplier 11, and an inverse conversion unit 9, and its result is supplied to an output terminal 10. The completely identical explanation is applicable also to an input terminal 13, a conversion unit 14, a suppression coefficient calculation unit 18, a multiplier 17, and an inverse conversion unit 15, and an output terminal 16.

Even though the noise suppression process is performed with a configuration of FIG. 26, a correct sound image positioning, which corresponds to of the input terminals 1, 7, and 13, cannot be obtained in the output terminals 4, 10, and 16. It might be due to the fact that the suppression coefficient of each channel is not one that is linearly calculated. So as to cope with this problem, the configuration of amending the inverse-converted signal is disclosed in Patent document 2.

The configuration disclosed in the Patent document 2 is for multiplying the noise-suppressed signal by the coefficient such that a deviation between an inter-channel power ratio at the time of the input and that at the time of the output is amended. With this, the inter-channel power ratio of the output side is equalized with that of the input side, thereby allowing the correct sound image positioning that corresponds to the input side to be obtained.

Patent document 1: JP-P2002-204175A

Patent document 2: JP-P2002-236500A

Non-patent document 1: PROCEEDINGS OF ICASSP, Vol. 1, pp. 473 to 476, May 2006

DISCLOSURE OF THE INVENTION

Problems to be Solved by the Invention

As it is, the configuration disclosed in the Patent document 2, which is for independently calculating the suppression coefficient for each channel and suppressing the noise, causes a problem that an increase in the number of the channels incurs an drastic increase in the arithmetic quantity.

Thereupon, the present invention has been accomplished in consideration of the above-mentioned problems, and an object thereof is to provide a noise suppression method, device, and program that enable the sound image positioning of the output side corresponding to the input side to be realized with a little arithmetic quantity.

Means for Solving the Problem

The present invention for solving the above-mentioned problems is a noise suppression method, which is characterized in obtaining a synthesis signal by synthesizing a plurality of input signals, settling a suppression degree common to the plurality of the input signals by employing the above synthesis signal, and suppressing noise being included in the plurality of the input signals with the above common suppression degree.

The present invention for solving the above-mentioned problems is a noise suppression device, which is characterized in including: a mixture unit for obtaining a synthesis signal by synthesizing a plurality of input signals; a gain calculation unit for settling a suppression degree common to the plurality of the input signals by employing the above synthesis signal; and a multiplier for suppressing noise being included in the plurality of the input signals with the above common suppression degree.

The present invention for solving the above-mentioned problems is a noise suppression program for causing a computer to execute the processes of: obtaining a synthesis signal by synthesizing a plurality of input signals, settling a suppression degree common to the plurality of the input signals by employing the above synthesis signal, and suppressing noise being included in the plurality of the input signals with the above common suppression degree.

That is, the noise suppression method, device and program of the present invention are characterized in calculating the suppression coefficient that is common to a plurality of channels, and employing this for the plurality of the channels.

More specifically, the noise suppression device is characterized in including a common suppression coefficient calculation unit for, upon receipt of conversion outputs of the plurality of the channels, calculating the suppression coefficient that is common to these channels.

An Advantageous Effect of the Invention

With the present invention, the entire number of the suppression coefficient calculation unit can be made smaller than the channel number because a plurality of the channels share one common suppression coefficient calculation unit. This enables a high-quality noise suppression to be accomplished with a little arithmetic quantity.

Further, the present invention makes it possible to realize the sound image positioning in the output side that corresponds to the input side because the common suppression coefficient is employed for a plurality of the channels.

DESCRIPTION OF NUMERALS

Figure 1:
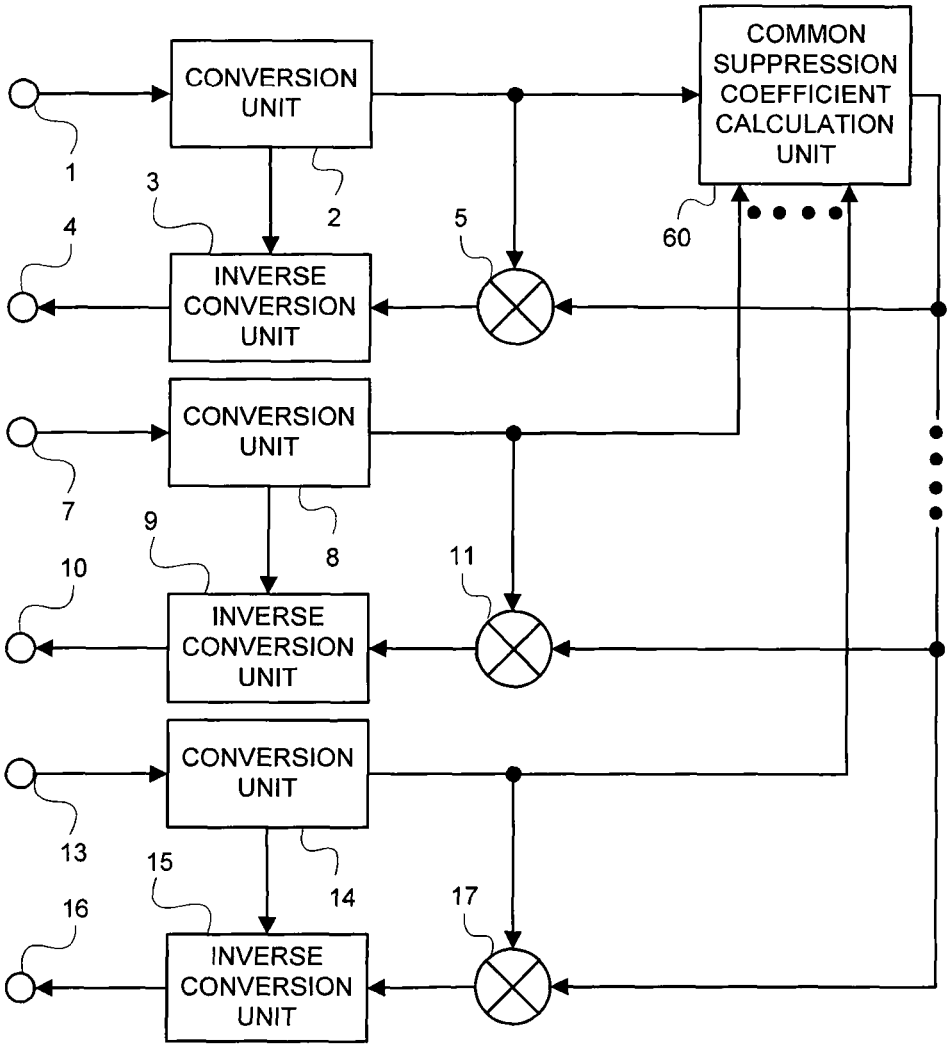
FIG. 1 is a block diagram illustrating a best mode of the present invention.

1, 17 and 13 input terminals
2, 8, and 14 conversion units
3, 9, and 15 inverse conversion units
4, 10, and 16 output terminals
5, 11, 17, $\mathbf{122}_0$ to $\mathbf{122}_{M-1}$, 3203, 6204, 6205, 6901, 6903, and 6507 multipliers
6, 12, and 18 suppression coefficient calculation units

21 frame division unit
22 and 32 windowing process units
23 Fourier transform unit
31 frame synthesis unit
33 inverse Fourier transform unit
60 common suppression coefficient calculation unit
100 mixture unit
110 averaging unit
120 selection unit
121 weight calculation unit
123 addition unit
124 and 6501 maximum value selection units
125 and 460 minimum value selection units
126, 430, and 6505 switches
200 and 210 spectral gain calculation units
300 noise estimation unit
310 estimated noise calculation unit
320 weighted degraded-sound calculation unit
330 and 480 counters
400 update determination unit
410 register length storage unit
420 and 3201 estimated noise storage units
440 shift register
450, 6208, 6902, and 6904 adders
470 division unit
500 sound detection unit
600 and 601 suppression coefficient generation unit
610 acquired SNR calculation unit
620 estimated inherent-SNR calculation unit
630 noise suppression coefficient calculation unit
640 sound non-existence probability storage unit
650 suppression coefficient amendment unit
921 momentarily-estimated SNR
922 past estimated SNR
923 weight
924 estimated inherent SNR
3202 by-frequency SNR calculation unit
3204 non-linear process unit
4001 logic sum calculation unit
4002, 4004, and 6504 comparison units
4003, 4005, and 6503 threshold storage units
4006 threshold calculation unit
6201 value range restriction processing unit
6202 acquired SNR storage unit
6203 suppression coefficient storage unit
6206 weight storage unit
6207 weighted addition unit
6301 MMSE STSA gain function value calculation unit
6302 generalized likelihood ratio calculation unit
6303 suppression coefficient calculation unit
6502 suppression coefficient lower-limit value storage unit
6506 correction value storage unit
6905 constant multiplier

BEST MODE FOR CARRYING OUT THE INVENTION

FIG. 1 is a block diagram illustrating the best mode of the present invention. FIG. 1 is identical to FIG. 26, being the conventional example, except for a common suppression coefficient calculation unit 60. Hereinafter, the detailed operation will be explained with this difference at a center.

Figure 26:
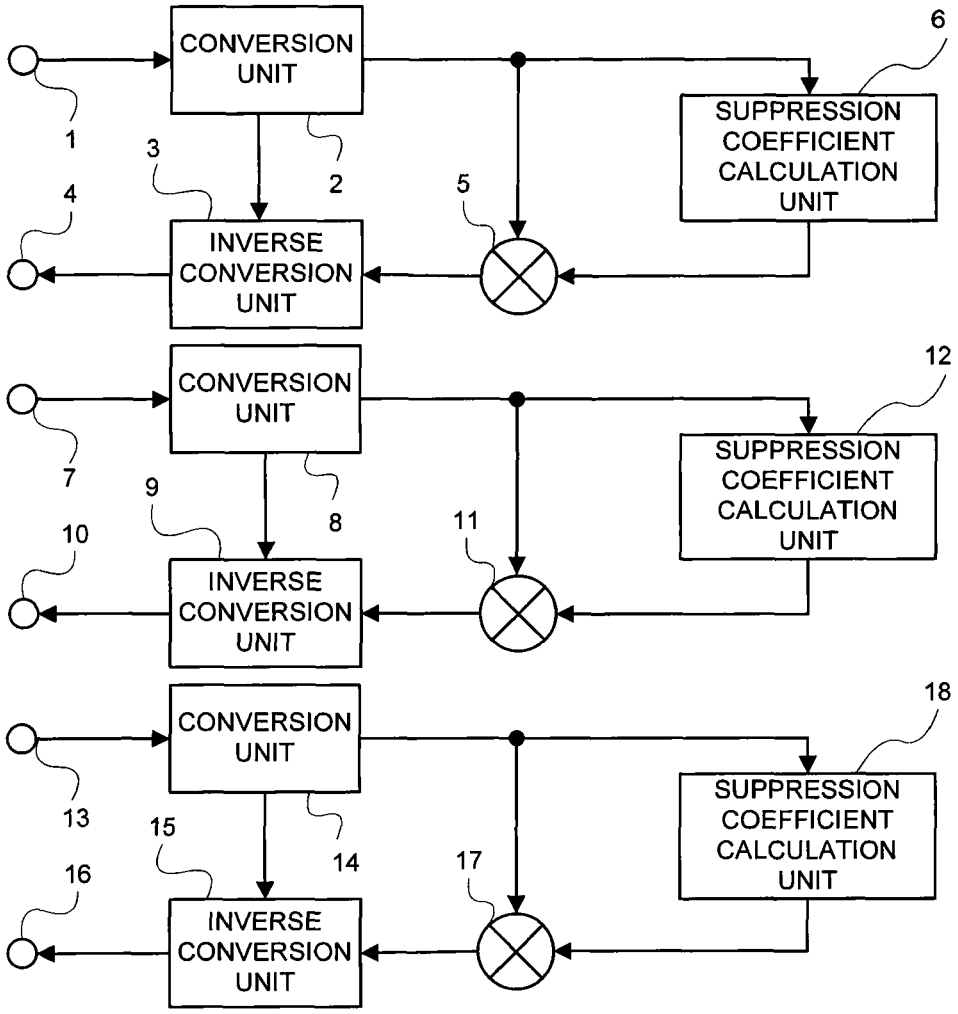
FIG. 26 PRIOR ART
FIG. 26 is a block diagram illustrating a configuration example of the conventional noise suppression device.

In FIG. 1, the suppression coefficient calculation units 6, 12 and 18 of FIG. 26 are deleted, and the common suppression coefficient calculation unit 60 is installed instead of them. The common suppression coefficient calculation unit 60, upon receipt of the power spectrum of the degraded sound converted into a frequency region by conversion units 2, 8, and 14, calculates a common suppression coefficient by employing theses. The calculated suppression coefficient is supplied to multipliers 5, 11, and 17.

Figure 2:
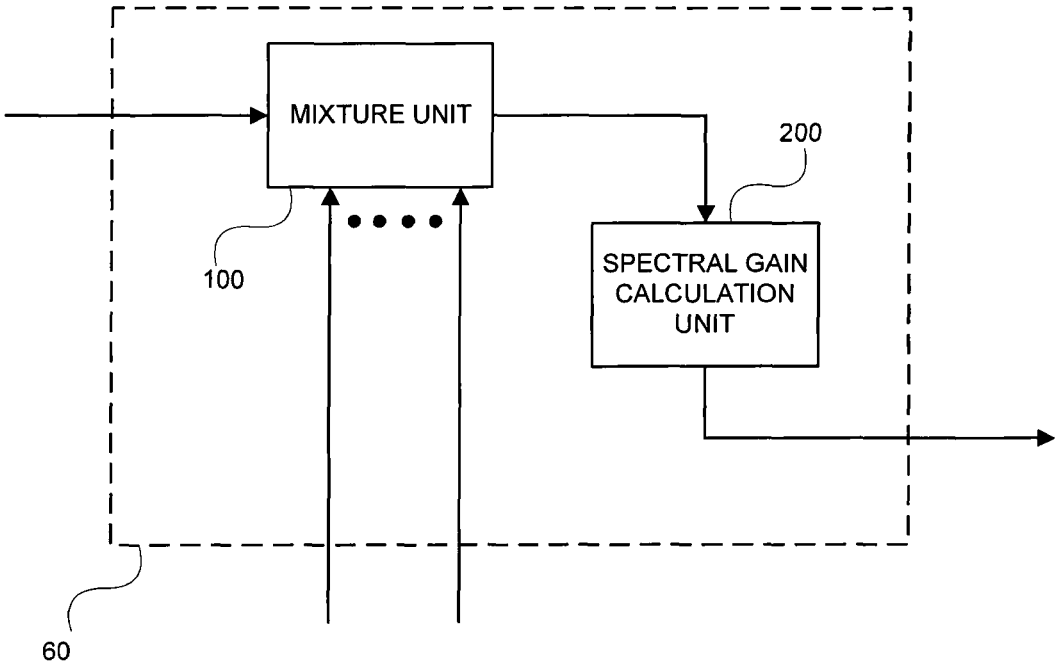
FIG. 2 is a block diagram illustrating a configuration of a common suppression coefficient calculation unit being included in the best mode of the present invention.

A configuration of the common suppression coefficient calculation unit 60 is shown in FIG. 2. The common suppression coefficient calculation unit 60 is configured of a mixture unit 100 and a spectral gain calculation unit 200. When the mixture unit receives the power spectrum of the degraded sound converted into a frequency region, which has been supplied from the conversion units 2, 8, and 14 of FIG. 1, it conveys a result obtained by mixing these to the spectral gain calculation unit 200. The spectral gain calculation unit 200 calculates the suppression coefficient by employing the signal supplied from the mixture unit 100, and output this as a common suppression coefficient.

Figure 3:
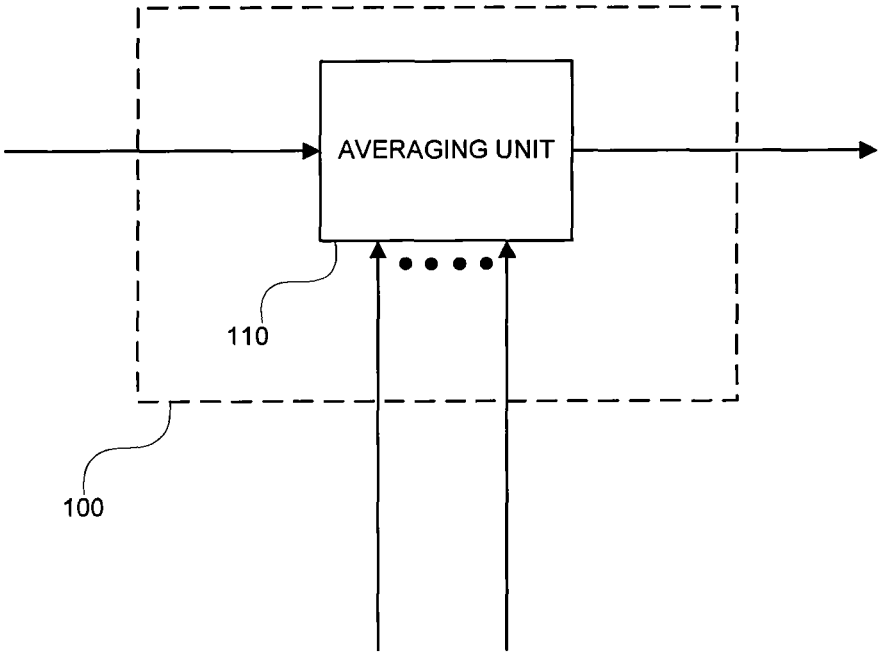
FIG. 3 is a block diagram illustrating a first configuration of a mixture unit being included in the best mode of the present invention.

In FIG. 3, a first example of a configuration of the mixture unit 100 is shown. The mixture unit 100 is configured as an averaging unit 110. The averaging unit 110 averages the power spectrums of a plurality of the inputted degraded sounds, and outputs an obtained average value.

Figure 4:
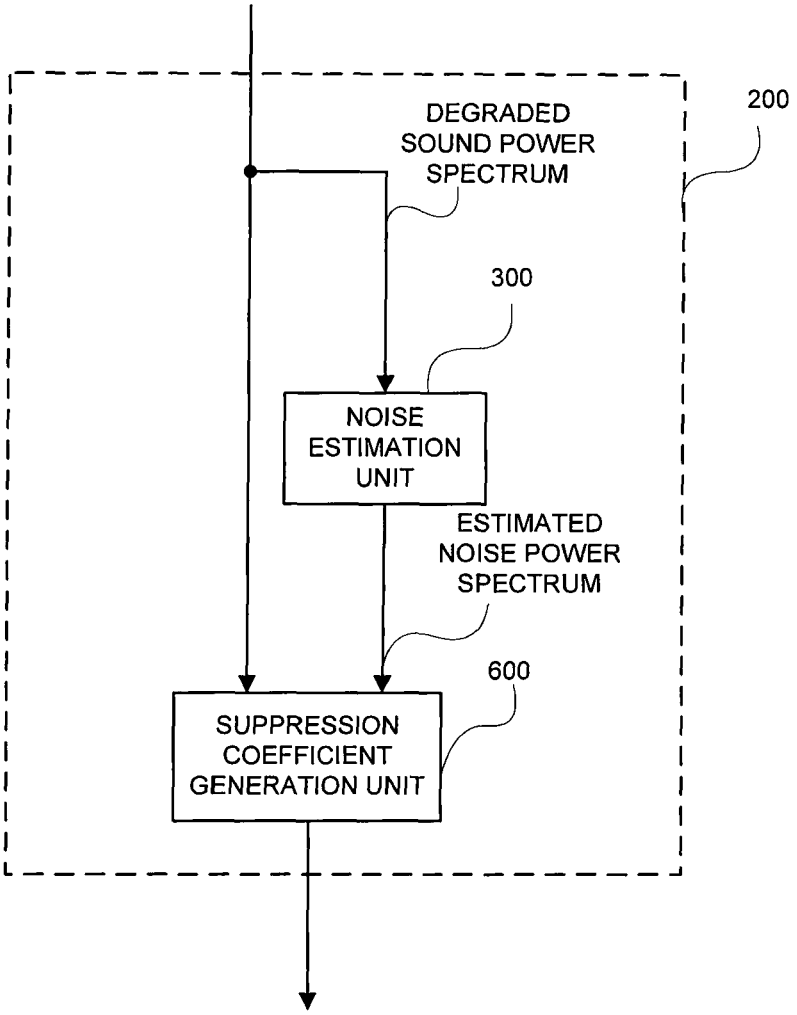
FIG. 4 is a block diagram illustrating a configuration of a spectral gain calculation unit being included in the best mode of the present invention.

FIG. 4 is a block diagram illustrating a configuration of the spectral gain calculation unit 200. The spectral gain calculation unit 200 is configured of a noise estimation unit 300 and a suppression coefficient generation unit 600. The power spectrum of the inputted degraded sound is supplied to the noise estimation unit 300 and the suppression coefficient generation unit 600. The noise estimation unit 300 employs the degraded sound power spectrum, estimates the power spectrum of the noise being included therein for each of a plurality of the frequency components, and conveys it to the suppression coefficient generation unit 600. As one example of the technique of estimating the noise, there exists the technique of weighting the degraded sound using a past signal to noise ratio as a weighting factor, and defining it as a noise component, and its details are described in the Patent document 1. The number of the estimated noise power spectrums is equal to that of the frequency components. The suppression coefficient generation unit 600 employs the supplied degraded sound power spectrum and estimated noise power spectrum, generates the suppression coefficient, by which the degraded sound is multiplied for a purpose of obtaining the noise-suppressed emphasized sound, and outputs this. The output of the suppression coefficient generation unit 600 is the suppression coefficient of which the number is identical to that of the frequency component because the suppression coefficient is obtained for each frequency component. The minimum square average short-time spectrum amplitude technique of minimizing the square average of the powers of the emphasized sounds is widely employed as one example of generating the noise suppression coefficient, and its details are described in the Patent document 1.

Figure 5:
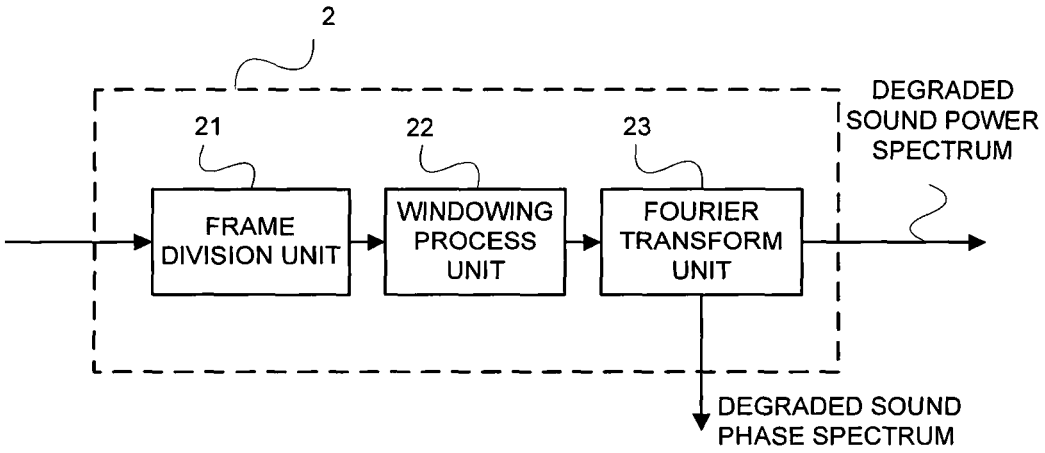
FIG. 5 is a block diagram illustrating a configuration of a conversion unit being included in the best mode of the present invention.

FIG. 5 is a block diagram illustrating a configuration of the conversion unit 2. Not only the conversion unit 8 but also the conversion unit 14 can be configured similarly to the conversion unit 2. Upon making a reference to FIG. 5, the conversion unit 2 is configured of a frame division unit 21, a windowing process unit 22, and a Fourier transform unit 23. A degraded sound signal sample is supplied to the frame division unit 21, and is divided into frames for each K/2 samples. Where, it is assumed that K is an even number. The degraded sound signal sample divided into the frames is supplied to the windowing process unit 22, and is multiplied by a window function w(t). A signal $y_n(t)$-bar that is obtained by windowing an input signal $y_n(t)$ (t=0, 1, . . . , K/2−1) of an n-th frame with w(t) is given by the following equation.

$$\bar{y}_n(t)=w(t)y_n(t) \quad \text{[Numerical equation 1]}$$

Further, it is also widely conducted to partially superpose (overlap) the continuous two frames upon each other for windowing. When it is assumed that an overlapping length is 50% of the frame length, $y_n(t)$-bar (t=0, 1, . . . , K−1), which is obtained with respect to t=0, 1, . . . , K/2-1 by the following equation, becomes an output of the windowing process unit 2.

$$\bar{y}_n(t)=w(t)y_{n-1}(t+K/2)$$

$$\bar{y}_n(t+K/2)=w(t+K/2)y_n(t) \quad \text{[Numerical equation 2]}$$

A symmetric window function is employed for a real-number signal. Further, the window function is designed so that the input signal at the time of having set the suppression coefficient to one (1) coincides with the output signal except for a calculation error. This means that w(t)+w(t+K/2)=1 is yielded.

From now on, the explanation is continued with the case of overlapping 50% of the continuous two frames upon each other for windowing taken as an example. As w(t), for example, a Hanning window shown in the following equation can be employed.

$$w(t)=\begin{cases} 0.5+0.5\cos\left(\dfrac{\pi(t-K/2)}{K/2}\right), & 0\le t<K \\ 0, & \text{otherwise} \end{cases} \quad \text{[Numerical equation 3]}$$

Besides this, various window functions such as a Humming window, a Kaiser window, and a Blackman window are known. The windowed output $y_n(t)$-bar is supplied to the Fourier transform unit 23, and is converted into a degraded sound spectrum $Y_n(k)$. The degraded sound spectrum $Y_n(k)$ is separated into a phase spectrum and an amplitude spectrum, a degraded sound phase spectrum arg $Y_n(k)$ is supplied to an inverse Fourier transform unit 33, and a degraded sound amplitude spectrum $|Y_n(k)|$ to the common suppression coefficient calculation unit 60.

Figure 6:
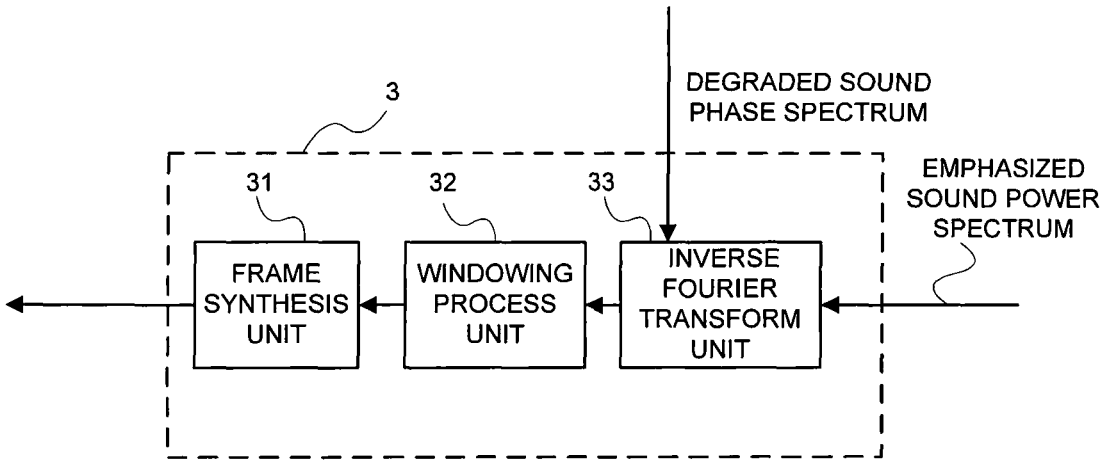
FIG. 6 is a block diagram illustrating a configuration of an inverse conversion unit being included in the best mode of the present invention.

FIG. 6 is a block diagram illustrating a configuration of the inverse conversion unit 3. Not only the inverse conversion unit 9 but also the inverse conversion unit 15 can be configured similarly to the inverse conversion unit 3. Upon making a reference to FIG. 6, the inverse conversion unit 3 is configured of an inverse Fourier transform unit 33, a windowing process unit 32, and a frame synthesis unit 31. The inverse Fourier transform unit 33 multiplies an emphasized sound amplitude spectrum $|X_n(k)|$-bar supplied from the multiplier 5 by the degraded sound phase spectrum arg $Y_n(k)$ supplied from the Fourier transform unit 23, thereby to obtain an emphasized sound $X_n(k)$-bar. That is, the inverse Fourier transform unit 33 executes the following equation.

$$\bar{X}_n(k)=|\bar{X}_n(k)|\cdot\arg Y_n(k) \quad \text{[Numerical equation 4]}$$

The obtained emphasized sound $X_n(k)$-bar is subjected to the inverse Fourier transform, is supplied to the windowing process unit 32 as a time region sample value sequence $x_n(t)$-bar (t=0, 1, . . . , K−1) of which one frame is configured of K samples, and is multiplied by the window function w(t). A signal $x_n(t)$-bar obtained by windowing an input signal $x_n(t)$ (t=0, 1, . . . , K/2−1) of an n-th frame with w(t) is given by the following equation.

$$\bar{x}_n(t)=w(t)x_n(t) \quad \text{[Numerical equation 5]}$$

Further, it is also widely conducted to partially superpose (overlap) the continuous two frames upon each other for windowing. When it is assumed that the overlapping length is 50% of the frame length, $y_n(t)$-bar (t=0, 1, . . . , K−1) that is obtained with respect t=0, 1, . . . , K/2-1 by the following equation becomes an output of the windowing process unit 32, and is conveyed to the frame synthesis unit 31.

$$\bar{x}_n(t)=w(t)x_{n-1}(t+K/2)$$

$$\bar{x}_n(t+K/2)=w(t+K/2)x_n(t) \quad \text{[Numerical equation 6]}$$

The frame synthesis unit 31 takes out K/2 samples from each of the neighboring two frames of $x_n(t)$-bar, and superposes them upon each other, and obtains an emphasized sound $x_n(t)$-hat by the following equation.

$$\hat{x}_n(t)=\bar{x}_{n-1}(t+/2)+\bar{x}n(t) \quad \text{[Numerical equation 7]}$$

The obtained emphasized-sound $x_n(t)$-hat (t=0, 1, . . . , K−1) is conveyed as an output of the frame synthesis unit 31 to the output terminal 4. While the explanation was made in FIG. 5 and FIG. 6 on the assumption that the conversion in the conversion unit and the inverse conversion unit was the Fourier transform, it is widely known that other conversions such as a cosine transform, a Hadamard transform, a Haar transform, and a wavelet transform can be employed instead of the Fourier transform.

Figure 7:
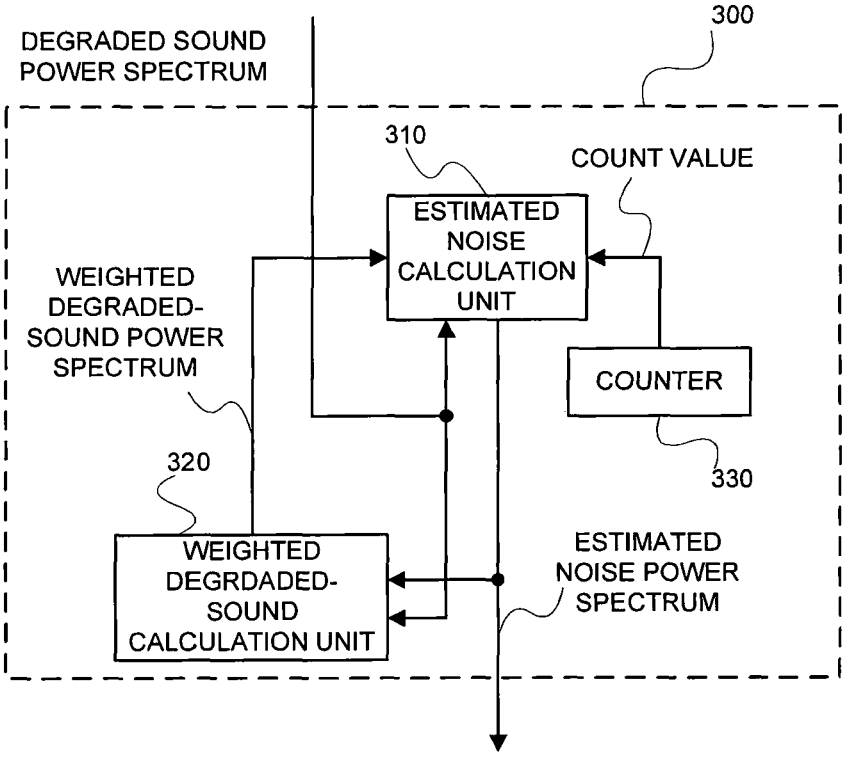
FIG. 7 is a block diagram illustrating a configuration of a noise estimation unit being included in the best mode of the present invention.

FIG. 7 is a block diagram illustrating a configuration of the noise estimation unit 300 of FIG. 4. The noise estimation unit 300 is configured of an estimated noise calculation unit 310, a weighted degraded-sound calculation unit 320, and a counter 330. The degraded sound power spectrum supplied to the noise estimation unit 300 is conveyed to the estimated noise calculation unit 310 and the weighted degraded-sound calculation unit 320. The weighted degraded-sound calculation unit 320 calculates a weighted degraded-sound power spectrum by employing the supplied degraded sound power spectrum and the estimated noise power spectrum, and conveys it to the estimated noise calculation unit 310. The estimated noise calculation unit 310 estimates the power spectrum of the noise by employing the degraded sound power spectrum, the weighted degraded-sound power spectrum, and a count value being supplied from the counter 330, outputs it as an estimated noise power spectrum, and simultaneously therewith, feedbacks it to the weighted degraded-sound calculation unit 320.

Figure 8:
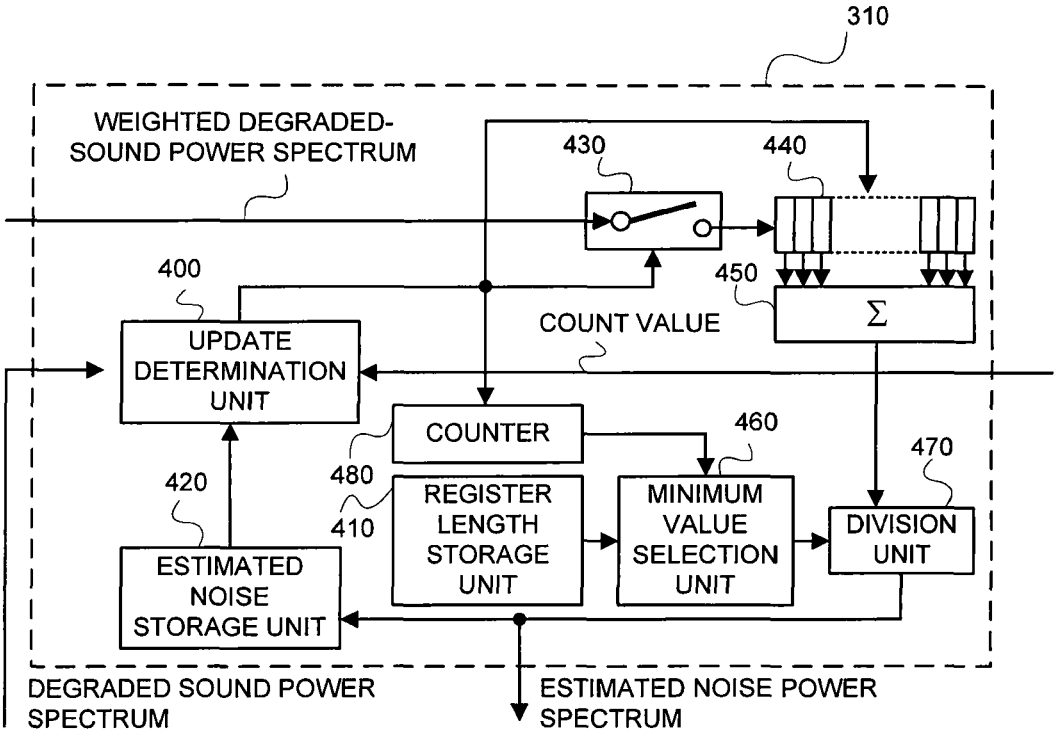
FIG. 8 is a block diagram illustrating a configuration of an estimated noise calculation unit being included in FIG. 7.

FIG. 8 is a block diagram illustrating a configuration of the estimated noise calculation unit 310 being included in FIG. 7. The estimated noise calculation unit 310 includes an update determination unit 400, a register length storage unit 410, an estimated noise storage unit 420, a switch 430, a shift register 440, an adder 450, a minimum value selection unit 460, a division unit 470, and a counter 480. The weighted degraded-sound power spectrum is supplied to the switch 430. When the switch 430 closes a circuit, the weighted degraded-sound power spectrum is conveyed to the shift register 440. The shift register 440, responding to a control signal being supplied from the update determination unit 400, shifts a storage value of the internal register to the neighboring register. A shift register length is equal to a value stored in a register length storage unit 410 to be later described. All of register outputs of the shift register 440 are supplied to the adder 450. The adder 450 adds all of the supplied register outputs, and conveys an addition result to the division unit 470.

On the other hand, the count value, a by-frequency degraded-sound power spectrum and a by-frequency estimated-noise power spectrum are supplied to the update determination unit 400. The update determination unit 400 outputs "1" at any time until the count value reaches a pre-set value, outputs "1" when it has been determined that the inputted degraded sound signal is noise after it reaches, and outputs "0" in the cases other than it, and coveys it to the counter 480, the switch 430, and the shift register 440. The switch 430 closes the circuit when the signal supplied from the update determination unit is "1", and opens the circuit when it is "0". The counter 480 increase the count value when the signal supplied from the update determination unit is "1", and does not change the count value when it is "0". The shift register 440 incorporates the signal sample being supplied from the switch 430 by one (1) sample when the signal supplied from the update determination unit is "1", and simultaneously therewith, shifts the storage value of the internal register to the neighboring register. The output of the counter 480 and the output of the register length storage unit 410 are supplied to the minimum value selection unit 460.

The minimum value selection unit 460 selects one of the supplied count value and register length, which is smaller, and conveys it to the division unit 470. The division unit 470 divides the addition value of the degraded sound power spectrum supplied from the adder 450 by one of the count value and the register length, which is smaller, and outputs a quotient as a by-frequency estimated-noise power spectrum $\lambda_n(k)$. Upon defining $B_n(k)$ (n=0, 1, . . . , N−1) as a sample value of the degraded sound power spectrum saved in the shift register 440, $\mu_n(k)$ is given by the following equation.

$$\lambda_n(k) = \frac{1}{N}\sum_{n=0}^{N-1} B_n(k)$$ [Numerical equation 8]

Where, N is one of the count value and the register length, which is smaller. The addition value is divided firstly by the count value, and later by the register length because the count value is increased monotonously, to begin with zero. Dividing the addition value by the register length means that the average value of the values stored in the shift register is obtained. At first, a sufficiently many values have not been stored in the shift register 440, whereby the division is executed by using the number of the registers into which the value has been actually stored. The number of the registers in which the value has been actually stored is equal to the count value when the count value is smaller than the register length, and becomes equal to the register length when the former becomes larger than the latter.

Figure 9:
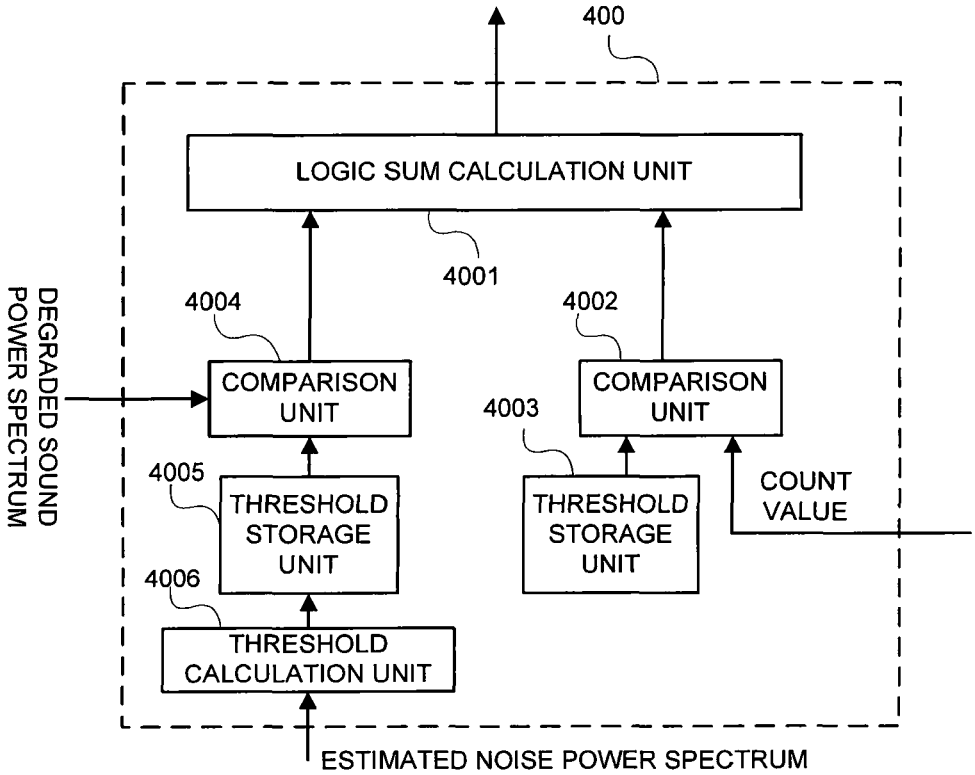
FIG. 9 is a block diagram illustrating a configuration of an update determination unit being included in FIG. 8.

FIG. 9 is a block diagram illustrating a configuration of the update determination unit 400 being included in FIG. 8. The update determination unit 400 includes a logic sum calculation unit 4001, comparison units 4004 and 4002, threshold storage units 4005 and 4003, and a threshold calculation unit 4006. The count value being supplied from the counter 330 of FIG. 7 is conveyed to the comparison unit 4002. The threshold as well, being an output of the threshold storage unit 4003, is conveyed to the comparison unit 4002. The comparison unit 4002 compares the supplied count value with the supplied threshold, and conveys "1" to the logic sum calculation unit 4001 when the former is smaller than the latter, and "0" when the former is larger than the latter. On the other hand, the threshold calculation unit 4006 calculates the value that corresponds to the estimated noise power spectrum being supplied from the estimated noise storage unit 420 of FIG. 8, and outputs it as a threshold to the threshold storage unit 4005. As a simplest method of calculating the threshold, a constant multiplication of the estimated noise power spectrum is defined as a threshold. Besides it, it is also possible to calculate the threshold by employing a high-order polynomial expression or a non-linear function. The threshold storage unit 4005 stores the threshold outputted from the threshold calculation unit 4006, and outputs the threshold stored one frame before to the comparison unit 4004. The comparison unit 4004 compares the threshold being supplied from the threshold storage unit 4005 with the degraded sound power spectrum being supplied from the mixture unit 100 of FIG. 2, and outputs "1" to when the latter is smaller than the former, and "0" when the latter is larger to the logic sum calculation unit 4001. That is, it is determined whether or not the degraded sound signal is noise based upon magnitude of the estimated noise power spectrum. The logic sum calculation unit 4001 calculates a logic sum of the output value of the comparison unit 4202 and the output value of the comparison unit 4204, and outputs a calculation result to the switch 430, the shift register 440, and the counter 480 of FIG. 8. In such a manner, when the degraded sound power is smaller not only in an initial state and in a soundless section but also in a sounded section, the update determination unit 400 outputs "1". That is, the estimated noise is updated. The estimated noise can be updated for each frequency because the calculation of the threshold is executed for each frequency.

Figure 10:
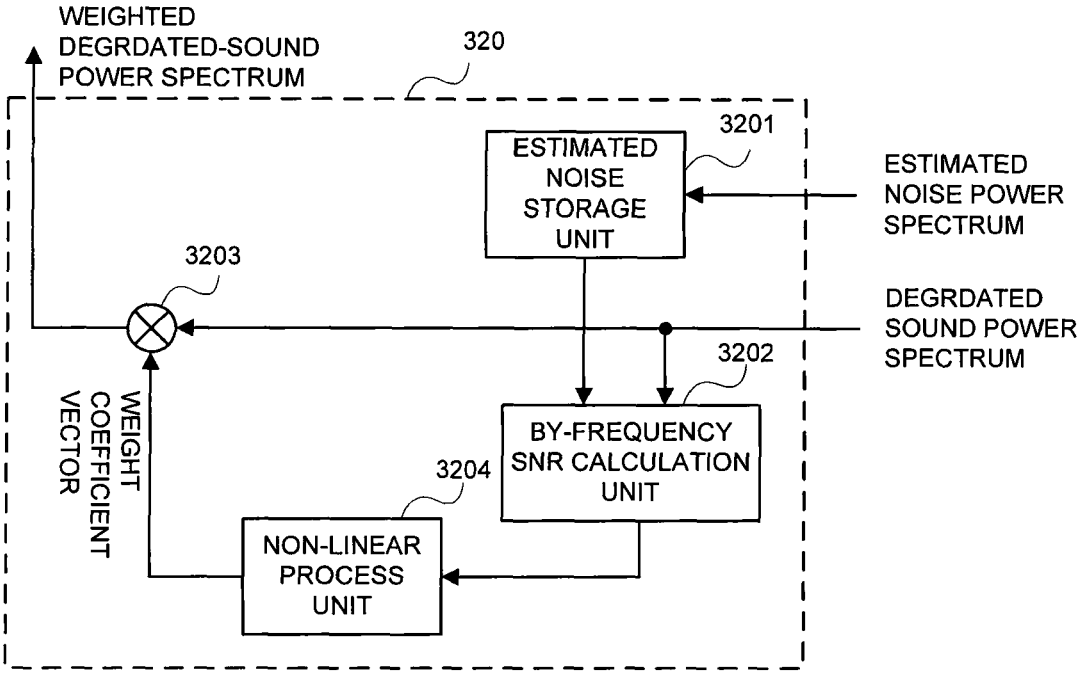
FIG. 10 is a block diagram illustrating a configuration of a weighted degraded-sound calculation unit being included in FIG. 7.

FIG. 10 is a block diagram illustrating a configuration of the weighted degraded-sound calculation unit 320. The weighted degraded-sound calculation unit 320 includes an estimated noise storage unit 3201, a by-frequency SNR calculation unit 3202, a non-linear process unit 3204, and a multiplier 3203. The estimated noise storage unit 3201 stores the estimated noise power spectrum being supplied from the estimated noise calculation unit 310 of FIG. 7, and outputs the estimated noise power spectrum stored one frame before to the by-frequency SNR calculation unit 3202. The by-frequency SNR calculation unit 3202 obtains the SNR for each frequency band by employing the estimated noise power spectrum being supplied from the estimated noise storage unit 3201 and the degraded sound power spectrum being supplied from the mixture unit 100 of FIG. 2, and outputs it to the non-linear process unit 3204. Specifically, the by-frequency SNR calculation unit 3202, according to the following equation, divides the supplied degraded sound power spectrum by the estimated noise power spectrum, thereby to obtain a by-frequency SNR $\gamma_n(k)$-hat.

$$\hat{\gamma}_n(k) = \frac{|Y_n(k)|^2}{\lambda_{n-1}(k)}$$ [Numerical equation 9]

Where, $\lambda_{n-1}(k)$ is the estimated noise power spectrum stored one frame before.

The non-linear process unit 3204 calculates a weight coefficient vector by employing the SNR being supplied from the by-frequency SNR calculation unit 3202, and outputs the weight coefficient vector to the multiplier 3203.

The multiplier 3203 calculates a product of the degraded sound power spectrum being supplied from the mixture unit 100 of FIG. 2 and the weight coefficient vector being supplied from the non-linear process unit 3204 frequency band by frequency band, and outputs a weighted degraded-sound power spectrum to the estimated noise calculation unit 310 of FIG. 7.

Figure 11:
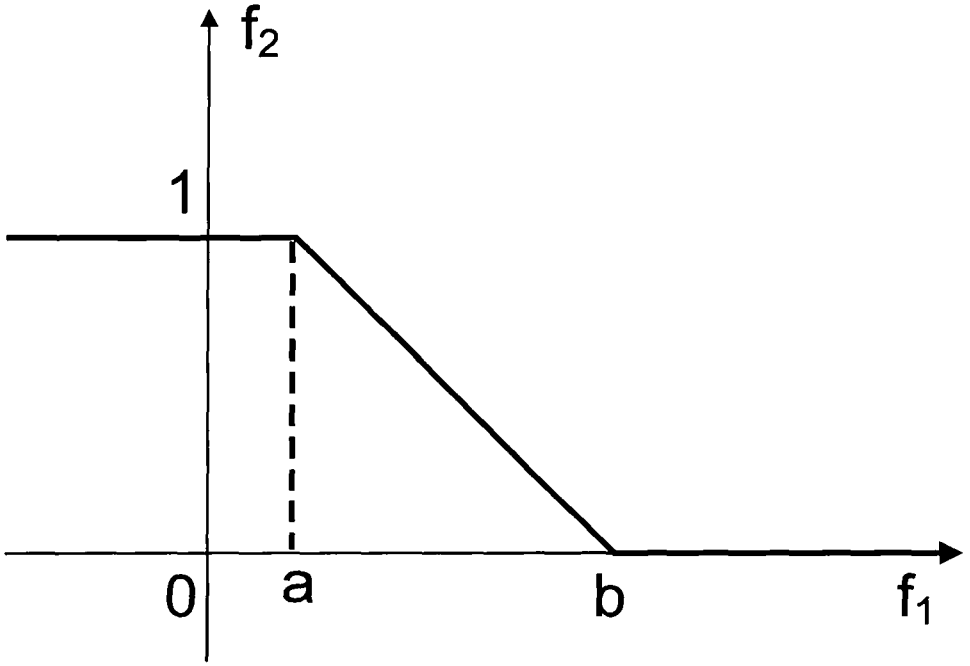
FIG. 11 is a view illustrating an example of a non-linear function in a non-linear process unit being included in FIG. 10.

The non-linear process unit 3204 has a non-linear function for outputting an actual value that corresponds to each of multiplexed input values. An example of the non-linear function is shown in FIG. 11. An output value $f_2$ of the non-linear function shown in FIG. 11 at the time of defining $f_1$ as an input value is given by the following equation.

[Numerical equation 10]

$$f_2 = \begin{cases} 1, & f_1 \le a \\ \dfrac{f_1 - b}{a - b}, & a < f_1 \le b \\ 0, & b < f_1 \end{cases}$$

Where, a and b are an optional actual number, respectively.

The non-linear process unit 3204 processes the by-frequency-band SNR being supplied from the by-frequency SNR calculation unit 3202 with the non-linear function, thereby to obtain the weight coefficient, and conveys it to the multiplier 3203. That is, the non-linear process unit 3204 outputs the weight coefficient of 1 up to 0 that corresponds to the SNR. It outputs 1 when the SNR is small, and 0 when the SNR is large.

The weight coefficient by which the degraded sound power spectrum is multiplexed in the multiplier 3203 of FIG. 10 is a value that corresponds to the SNR, and the larger the SNR is, namely, the larger the sound component being included in the degraded sound is, the smaller the value of the weight coefficient becomes. While, as a rule, the degraded sound power spectrum is employed for updating the estimated noise, conducting a weighting, which corresponds to the SNR, for the degraded sound power spectrum, which is employed for updating the estimated noise, enables an influence of the sound component being included in the degraded sound power spectrum to be reduced, and a higher-precision noise estimation to be performed. Additionally, while an example employing the non-linear function for calculating the weight coefficient was shown, it is also possible to employ the function of the SNR that is expressed in other formats, for example, a linear function and a high-order polynomial expression besides the non-linear function.

Figure 12:
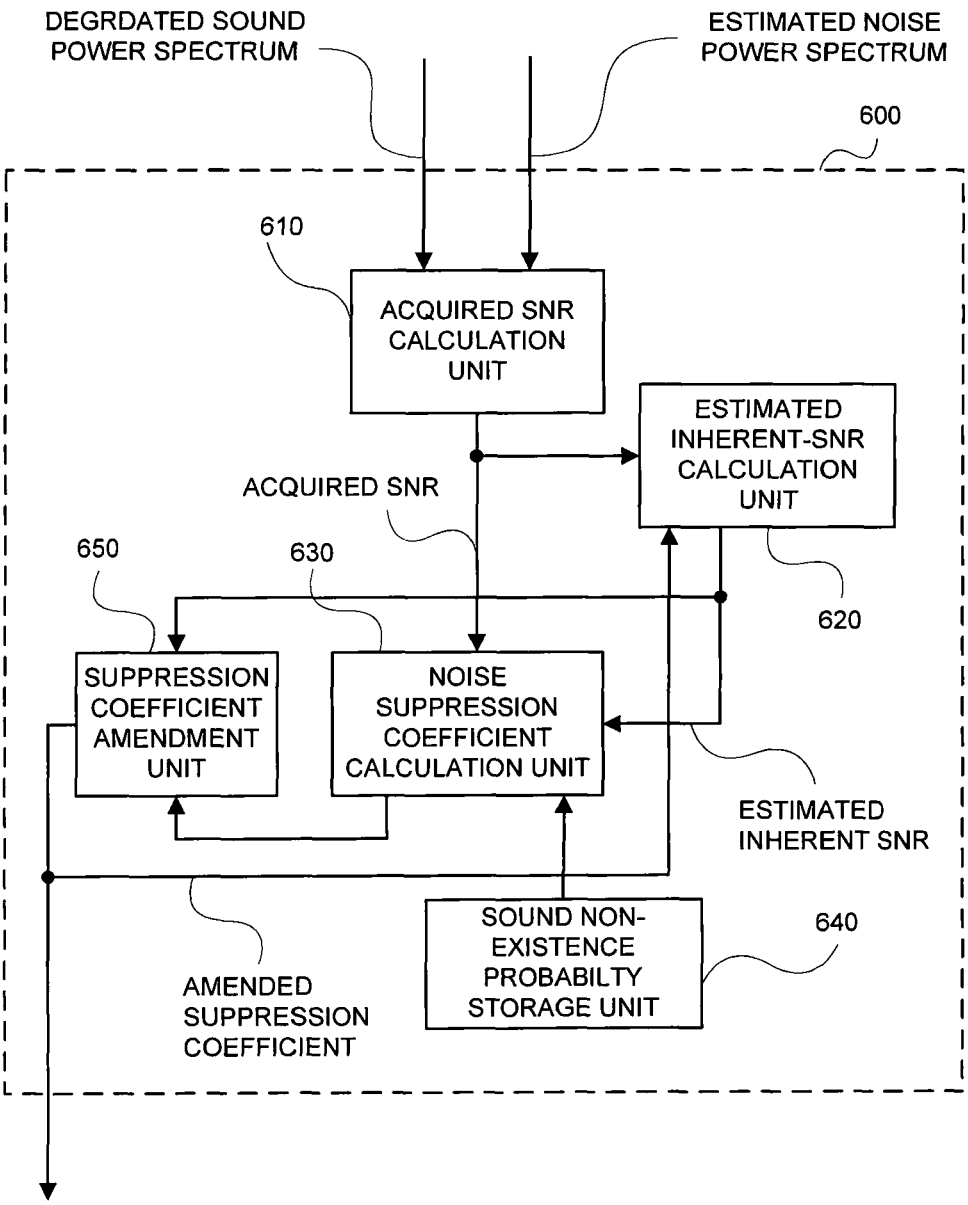
FIG. 12 is a block diagram illustrating a configuration of a suppression coefficient generation unit being included in FIG. 4.

FIG. 12 is a block diagram illustrating a configuration of the suppression coefficient generation unit 600 being included in FIG. 4. The suppression coefficient generation unit 600 includes an acquired SNR calculation unit 610, an estimated inherent-SNR calculation unit 620, a noise suppression coefficient calculation unit 630, a sound non-existence probability storage unit 640, and a suppression coefficient amendment unit 650. The acquired SNR calculation unit 610 calculates the acquired SNR for each frequency by employing the inputted degraded sound power spectrum and estimated noise power spectrum, and supplies a calculation result to the estimated inherent-SNR calculation unit 620 and the noise suppression coefficient calculation unit 630. The estimated inherent-SNR calculation unit 620 estimates the inherent SNR by employing the inputted acquired SNR, and the amended suppression coefficient supplied from the suppression coefficient amendment unit 650, and conveys an estimation result as an estimated inherent SNR to the noise suppression coefficient calculation unit 630. The noise suppression coefficient calculation unit 630 generates a noise suppression coefficient by employing the acquired SNR supplied as an input, the estimated inherent SNR, and a sound non-existence probability being supplied from the sound non-existence probability storage unit 640, and conveys it to the suppression coefficient amendment unit 650. The suppression coefficient amendment unit 650 amends the noise suppression coefficient by employing the inputted estimated inherent SNR and the noise suppression coefficient, and outputs it as an amended suppression coefficient $C_n$(k)-bar.

Figure 13:
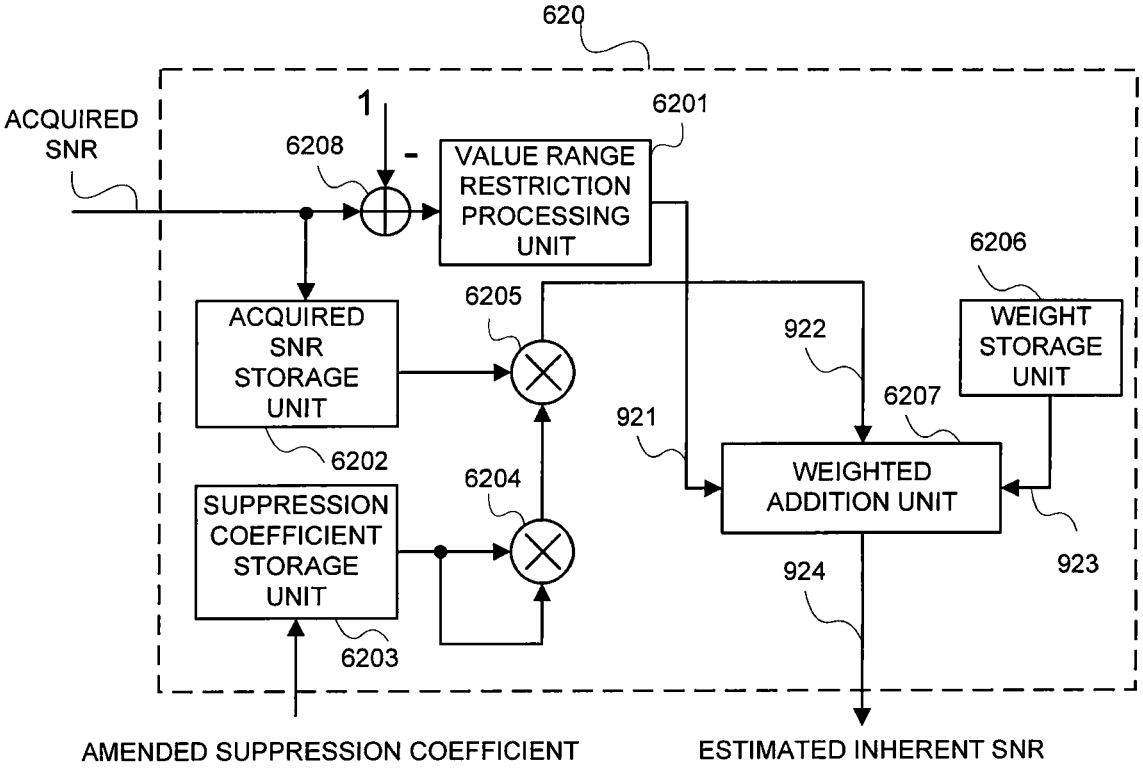
FIG. 13 is a block diagram illustrating a configuration of an estimated inherent-SNR calculation unit being included in FIG. 12.

FIG. 13 is a block diagram illustrating a configuration of the estimated inherent-SNR calculation unit 620 being included in FIG. 12. The estimated inherent-SNR calculation unit 620 includes a value range restriction processing unit 6201, an acquired SNR storage unit 6202, a suppression coefficient storage unit 6203, multipliers 6204 and 6205, a weight storage unit 6206, a weighted addition unit 6207, and an adder 6208. An acquired SNR $\gamma_n$(k) (k=0, 1, . . . , M−1) being supplied from the acquired SNR calculation unit 610 of FIG. 12 is conveyed to the acquired SNR storage unit 6202 and the adder 6208. The acquired SNR storage unit 6202 stores the acquired SNR $\gamma_n$(k) of the n-th frame and conveys the acquired SNR $\gamma_{n-1}$(k) of the (n−1)-th frame to the multiplier 6205. The amended suppression coefficient $G_n$(k)-bar (k=0, 1, . . . , M−1) being supplied from the suppression coefficient amendment unit 650 of FIG. 12 is conveyed to the suppression coefficient storage unit 6203. The suppression coefficient storage unit 6203 stores the amended suppression coefficient $G_n$(k)-bar of the n-th frame and conveys the amended suppression coefficient $G_{n-1}$(k)-bar of the (n−1)-th frame to the multiplier 6204. The multiplier 6204 obtains $G^2_{n-1}$(k)-bar by squaring the supplied $G_{n-1}$(k)-bar, and conveys it to the multiplier 6205. The multiplier 6205 obtains $G^2_{n-1}$(k)-bar $\gamma_{n-1}$(k) by multiplying $G^2_{n-1}$(k)-bar by $\gamma_{n-1}$(k) with respect to k=0, 1, . . . , M−1, and conveys a result as a past estimated SNR 922 to the weighted addition unit 6207.

−1 is supplied to another terminal of the adder 6208, and an addition result $\gamma_n$(k)−1 is conveyed to the value range restriction processing unit 6201. The value range restriction processing unit 6201 subjects the addition result $\gamma_n$(k)−1 supplied from the adder 6208 to an operation by a value range restriction operator P[•], and conveys P[y (k)−1], being a result, as a momentarily-estimated SNR 921 to the a weighted addition unit 6207. Where, P[x] is decided by the following equation.

[Numerical equation 11]

$$P[x] = \begin{cases} x, & x > 0 \\ 0, & x \le 0 \end{cases}$$

Further, a weight 923 is supplied to the weighted addition unit 6207 from the weight storage unit 6206. The weighted addition unit 6207 obtains an estimated inherent SNR 924 by employing these supplied momentarily-estimated SNR 921, past estimated SNR 922, and weight 923. Upon defining the weight 923 as α, and $\xi_n$(k)-hat as an estimated inherent SNR, the $\xi_n$(k)-hat is calculated by the following equation.

$$\hat{\xi}(k)=\alpha\gamma_{n-1}(k)\overline{G}^2_{n-1}(k)+(1-\alpha)P[\gamma_n(k)-1] \quad \text{[Numerical equation 12]}$$

Where, it is assumed that $G^2$_1(k) $\gamma_{-1}$(k)-bar=1.

Figure 14:
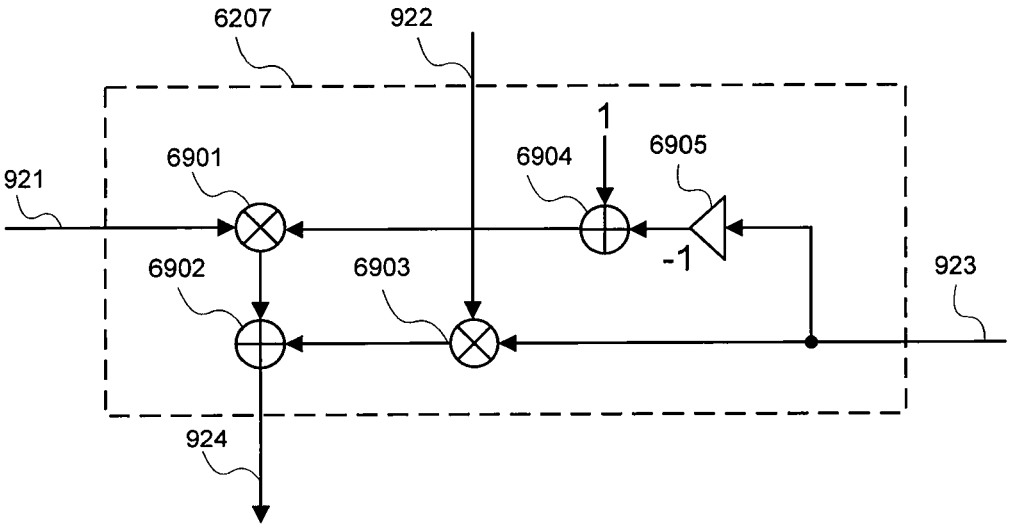
FIG. 14 is a block diagram illustrating a configuration of a weighted addition unit being included in FIG. 13.

FIG. 14 is a block diagram illustrating a configuration of the weighted addition unit 6207 being included in FIG. 13. The weighted addition unit 6207 includes multipliers 6901 and 6903, a constant multiplier 6905, and adders 6902 and 6904.

The by-frequency-band momentarily-estimated SNR 921 is supplied from the value range restriction processing unit 6201 of FIG. 13, the past estimated SNR 922 from the multiplier 6205 of FIG. 13, and the weight 923 from the weight storage unit 6206 of FIG. 13 as an input, respectively. The weight 923 having a value α is conveyed to the constant multiplier 6905 and the multiplier 6903. The constant multiplier 6905 conveys −α obtained by multiplying the input signal by −1 to the adder 6904. 1 is supplied as another input to the adder 6904, and the output of the adder 6904 becomes 1−α, being a sum of both. 1−α is supplied to the multiplier 6901 and is multiplied by a by-frequency-band momentarily-estimated SNR P[$\gamma_n$(k)−1], being another input, and (1−α)P[$\gamma_n$(k)−1], being a product, is conveyed to the adder 6902. On the other hand, the multiplier 6903 multiplies a supplied as the weight 923 by the past estimated SNR 922, and conveys α$G^2_{n-1}$(k)-bar $\gamma_{n-1}$(k), being a product, to the adder 6902. The adder 6902 outputs a sum of (1−α)P[$\gamma_n$(k)−1] and α$G^2_{n-1}$(k)-bar $\gamma_{n-1}$(k) as a by-frequency-band estimated inherent SNR 904.

Figure 15:
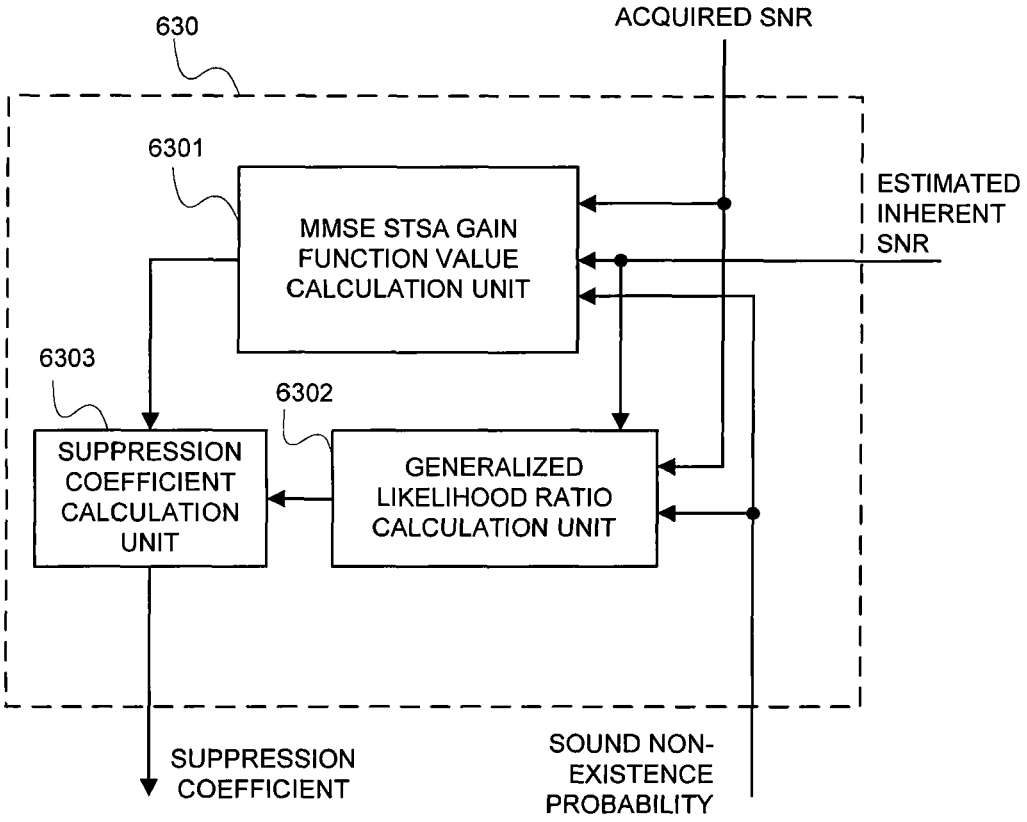
FIG. 15 is a block diagram illustrating a configuration of a noise suppression coefficient calculation unit being included in FIG. 12.

FIG. 15 is a block diagram illustrating a configuration of the noise suppression coefficient calculation unit 630 being included in FIG. 12. The noise suppression coefficient calculation unit 630 includes an MMSE STSA gain function value calculation unit 6301, a generalized likelihood ratio calculation unit 6302, and a suppression coefficient calculation unit 6303. Hereinafter, how to calculate the suppression coefficient will be explained based upon the calculation equation described in Non-patent document 2 (IEEE TRANSACTIONS ON ACOUSTICS, SPEECH, AND SIGNAL PROCESSING, Vol. 32, No. 6, pp. 1109 to 1121, December, 1984).

It is assumed that the frame number is n, the frequency number is k, $\gamma_n$/(k) is a by-frequency acquired SNR being supplied from the acquired SNR calculation unit 610 of FIG. 12, $\xi_n$(k)-hat is a by-frequency estimated inherent SNR being supplied from the estimated inherent-SNR calculation unit 620 of FIG. 12, and q is a sound non-existence probability being supplied from the sound non-existence probability storage unit 640 of FIG. 12. Further, it is assumed that $\eta_n$(k)=$\xi_n$(k)-hat/(1−q), and $v_n$(k)=($\eta_n$(k))$\gamma_n$(k)/(1+$\eta_n$(k)). The MMSE STSA gain function value calculation unit 6301 calculates an MMSE STSA gain function value frequency band by frequency band based upon the acquired SNR $\gamma_n$(k) being supplied from the acquired SNR calculation unit 610 of FIG. 12, the estimated inherent SNR $\xi_n$(k)-hat being supplied from the estimated inherent-SNR calculation unit 620 of FIG. 12, and the sound non-existence probability q being supplied from the sound non-existence probability storage unit 640 of FIG. 12, and outputs it to the suppression coefficient calculation unit 6303. An MMSE STSA gain function value $G_n$(K) by the frequency band is given by the following equation.

$$G_n(k)=\frac{\sqrt{\pi}}{2}\frac{\sqrt{v_n(k)}}{\gamma_n(k)}\exp\left(-\frac{v_n(k)}{2}\right) \quad \text{[Numerical equation 13]}$$

-continued $$\left[(1+v_n(k))I_0\left(\frac{v_n(k)}{2}\right)+v_n(k)I_1\left(\frac{v_n(k)}{2}\right)\right]$$

Where, $I_0$(z) is a zero-order modified Bessel function, and $I_1$(z) is a first-order modified Bessel function. The modified Bessel function is described in Non-patent document 3 (Mathematics Dictionary, 374. G page, Iwanami Shoten, Publishers, 1985)

The generalized likelihood ratio calculation unit 6302 calculates a generalized likelihood ratio frequency band by frequency band based upon the acquired SNR $\gamma_n$(k) being supplied from the acquired SNR calculation unit 610 of FIG. 12, the estimated inherent SNR $\xi_n$(k)-hat being supplied from the estimated inherent-SNR calculation unit 620 of FIG. 12, and the sound non-existence probability q being supplied from the sound non-existence probability storage unit 640 of FIG. 12, and conveys it to the suppression coefficient calculation unit 6303. A generalized likelihood ratio $\Lambda_n$(k) by the frequency band is given by the following equation.

$$\Lambda_n(k)=\frac{1-q}{q}\frac{\exp(v_n(k))}{1+\eta_n(k)} \quad \text{[Numerical equation 14]}$$

The suppression coefficient calculation unit 6303 calculates the suppression coefficient frequency by frequency from the MMSE STSA gain function value $G_n$(k) being supplied from the MMSE STSA gain function value calculation unit 6301, and the generalized likelihood ratio $\Lambda_n$(k) being supplied from the generalized likelihood ratio calculation unit 6302, and outputs it to the suppression coefficient amendment unit 650 of FIG. 12. A suppression coefficient $G_n$ (k)-bar by the frequency band is given by the following equation.

$$\overline{G}_n(k)=\frac{\Lambda_n(k)}{\Lambda_n(k)+1}G_n(k) \quad \text{[Numerical equation 15]}$$

It is also possible to obtain the SNR common to a wide band that is configured of a plurality of the frequency bands and to employ it instead of calculating the SNR frequency band by frequency band.

Figure 16:
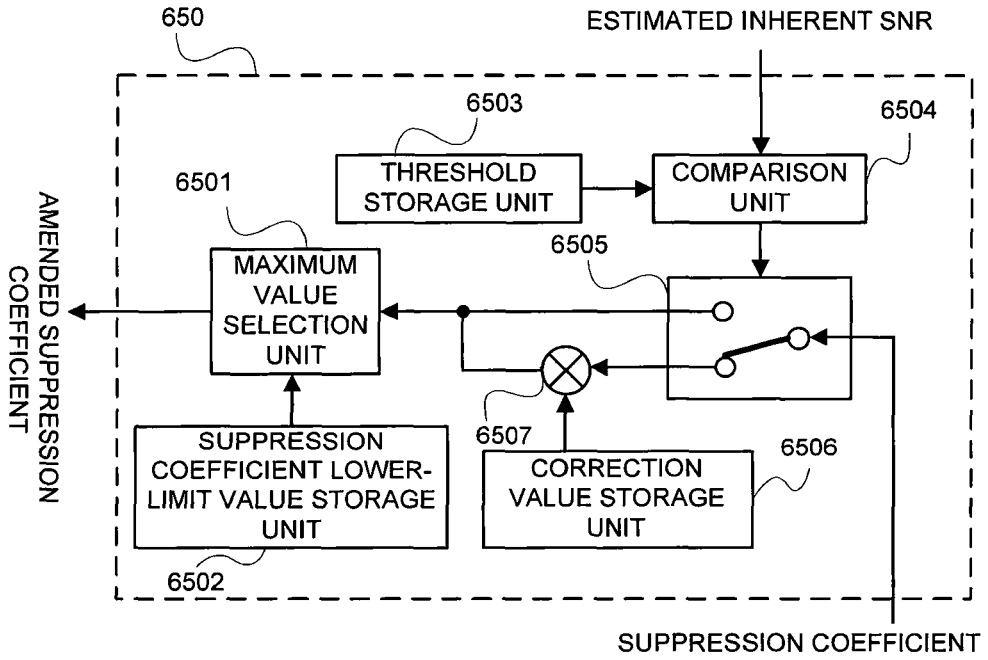
FIG. 16 is a block diagram illustrating a configuration of a suppression coefficient amendment unit being included in FIG. 12.

FIG. 16 is a block diagram illustrating a configuration of the suppression coefficient amendment unit 650 being included in FIG. 12. The suppression coefficient amendment unit 650 includes a maximum value selection unit 6501, a suppression coefficient lower-limit value storage unit 6502, a threshold storage unit 6503, a comparison unit 6504, a switch 6505, a correction value storage unit 6506, and a multiplier 6507. The comparison unit 6504 compares the threshold being supplied from threshold storage unit 6503 with the estimated inherent SNR being supplied from the estimated inherent-SNR calculation unit 620 of FIG. 12 and supplies "0" to the switch 6505 when the latter is larger than the former, and "1" when the latter is smaller. The switch 6505 outputs the suppression coefficient being supplied from the noise suppression coefficient calculation unit 630 of FIG. 12 to the multiplier 6507 when the output value of the comparison unit 6504 is "1", and to the maximum value selection unit 6501 when it is "0". That is, the suppression coefficient is amended when the estimated inherent SNR is smaller than the threshold. The multiplier 6507 calculates a product of the output value of the switch 6505 and the output value of the correction value storage unit 6506, and conveys it to the maximum value selection unit 6501.

On the other hand, the suppression coefficient lower-limit value storage unit 6502 supplies the lower limit value stored by the suppression coefficient lower-limit value storage unit 6502 itself to the maximum value selection unit 6501. The maximum value selection unit 6501 compares the suppression coefficient being supplied from the noise suppression coefficient calculation unit 630 of FIG. 12 or the product calculated in the multiplier 6507 with the lower limit value being supplied from the suppression coefficient lower-limit value storage unit 6502, and outputs the value, which is larger. That is, the suppression coefficient becomes a value that is larger than the lower limit value stored by the suppression coefficient lower-limit value storage unit 6502 without fail.

Additionally, in the embodiment so far, an example of independently calculating the suppression coefficient for each frequency component, and performing the noise suppression by employing it was explained according to the Patent document 1. However, as disclosed in the Non-patent document 1, so as to curtail the arithmetic quantity, it is also possible to calculate the suppression coefficient common to a plurality of the frequency components, and to perform the noise suppression by employing it. This case requires a configuration of installing a band integration unit between the mixture unit 100 and the spectral gain calculation unit 200 of FIG. 2.

In addition hereto, as described in the Non-patent document 1, installing an offset deletion unit in the downstream side of the conversion unit 2 of FIG. 1, and an amplitude amendment unit and a phase amendment unit just in the upstream side of the conversion unit 2 makes it possible to form a high-band passage filter as well in the frequency region, and to curtail the arithmetic quantity. Further, the noise estimation value can be also amended responding to a specific frequency band at the moment of calculating the suppression coefficient common to a plurality of the frequency components.

Figure 17:
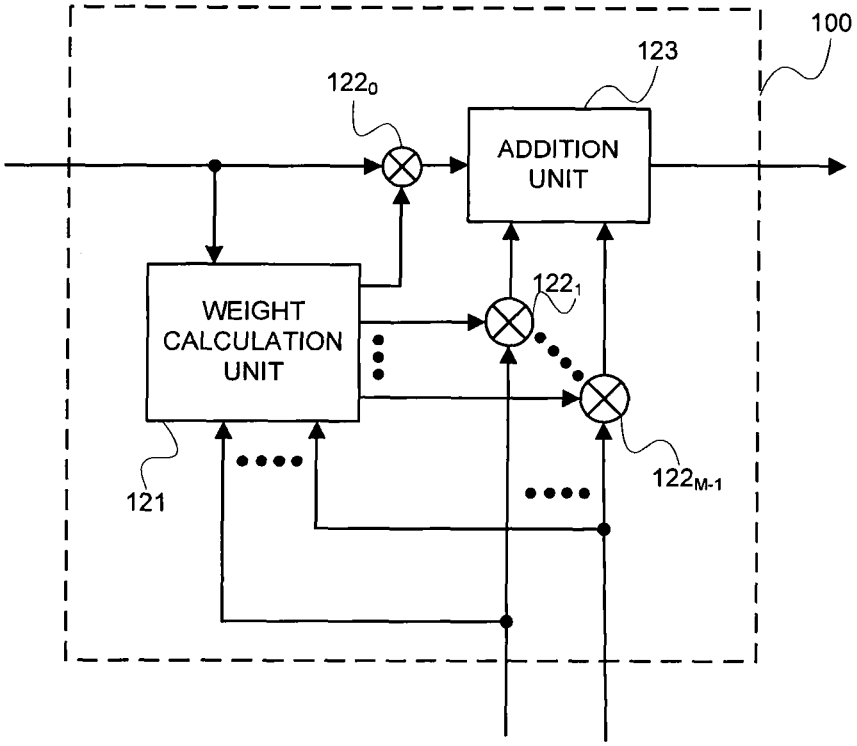
FIG. 17 is a block diagram illustrating a second configuration of the mixture unit.

A second example of the mixture unit 100 is shown in FIG. 17. The mixture unit 100 is configured of a weight calculation unit 121, multipliers $\mathbf{122}_0$ to $\mathbf{122}_{M-1}$, and an addition unit 123. The mixture unit 100 executes a weighted addition for the power spectrums of a plurality of the inputted degraded sounds, and outputs its result. The power spectrums of a plurality of the inputted degraded sounds are supplied to the weight calculation unit 121 and the multipliers $\mathbf{122}_0$ to $\mathbf{122}_{M-1}$. The weight calculation unit normalizes respective power spectrums using a sum of all of the power spectrums as a normalization factor, defines it as a weight, and supplies it the multipliers $\mathbf{122}_0$ to $\mathbf{122}_{M-1}$ that correspond hereto. The multipliers $\mathbf{122}_0$ to $\mathbf{122}_{M-1}$ calculate a product of the corresponding weight and the power spectrum of the inputted degraded sound, and convey its result to the addition unit 123. The addition unit 123 obtains a sum of the products supplied from the multipliers $\mathbf{122}_0$ to $\mathbf{122}_{M-1}$, and outputs it. In the second example explained above, as compared with the first example, a contribution of the channel of the high signal level becomes large at the moment of calculating the spectral gain. The high signal level is equivalent to a sound section in which the SNR is high. For this, the spectral gain becomes large, thereby enabling the emphasized sound, of which the distortion is few as a whole, to be obtained.

Further, in the second example of the mixture unit 100, it is also possible to normalize a sum of all of the power spectrums using respective power spectrums as a normalization factor, thereby to define it as a weight. When the weight is obtained in such a manner, a contribution of the channel of the low signal level becomes large at the moment of calculating the spectral gain. The low signal level is equivalent to a noise section in which the SNR is low. For this, the spectral gain becomes small, thereby enabling the emphasized sound, of which the residual noise is few as a whole, to be obtained.

Further, in the second example of the mixture unit 100, it is also possible that, after normalizing respective power spectrums using a sum of all of the power spectrums as a normalization factor, an amendment scheme based upon a psychologically auditory sense is applied therefor, and then, the amendment value is defined as a weight. As one example of the amendment scheme based upon a psychologically auditory sense, there exists an emphasis of the weight upon the high-band component. The reason is that it is known that the positioning of a sound source is primarily carried out based upon the amplitude in the high-frequency component. By obtaining the weight in such a manner, a contribution of the channel including the high-frequency component becomes large at the moment of calculating the spectral gain. With this, the accurate positioning of the sound image can be accomplished in these channels, thereby enabling an enhancement in the subjective sound quality to be expected.

Figure 18:
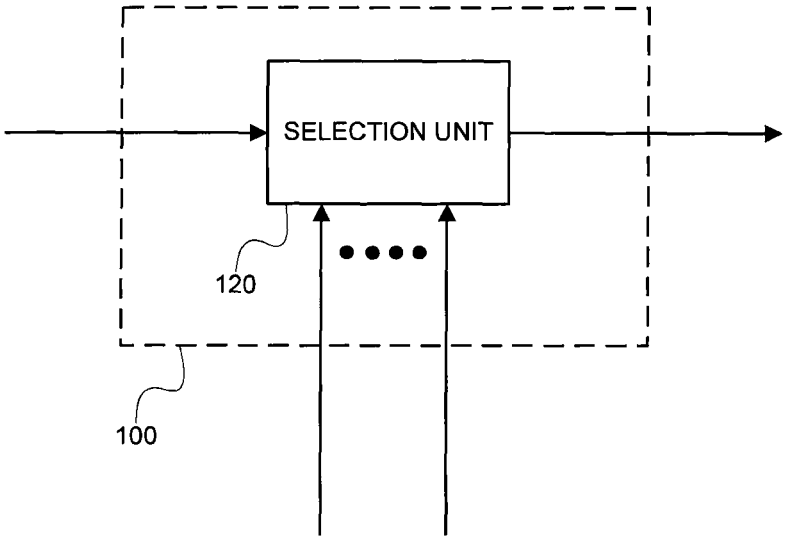
FIG. 18 is a block diagram illustrating a third configuration of the mixture unit.

A third example of the mixture unit 100 is shown in FIG. 18. The mixture unit 100 is configured of a selection unit 120. The selection unit selects at least one power spectrum from among the power spectrums of a plurality of the inputted degraded sounds, and outputs its result. For example, the maximum value can be set as criteria of the selection. At this time, the maximum value of the power spectrum, out of the power spectrums of a plurality of the inputted degraded sounds, is obtained in the output of the selection unit 120. The maximum value of the spectrum is equivalent to the sound section in which the SNR is high. For this, the spectral gain becomes large, thereby enabling the emphasized sound, of which the distortion is few as a whole, to be obtained. Further, when the minimum value is set as criteria of the selection, an operation completely contrary hereto is expected. That is, the minimum value of the spectrum is equivalent to the noise section in which the SNR is low. For this, the spectral gain becomes small, thereby enabling the emphasized sound, of which the residual noise is few as a whole, to be obtained.

Figure 19:
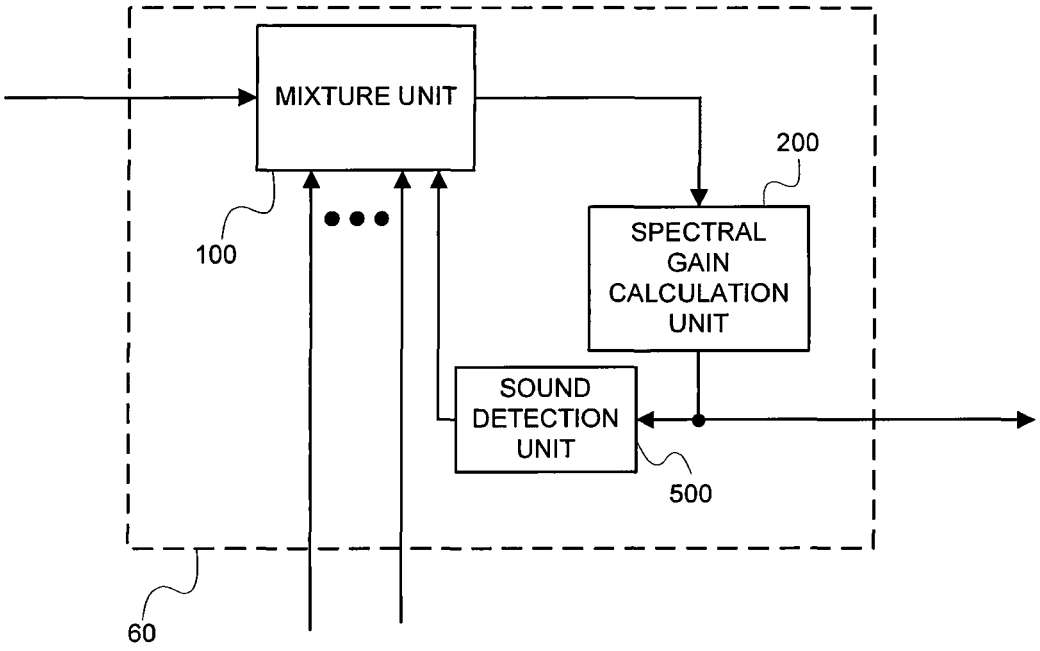
FIG. 19 is a block diagram illustrating a second embodiment of the present invention.

FIG. 19 is a block diagram illustrating the second embodiment of the present invention. FIG. 19 is identical to FIG. 2 signifying the best mode except for a point that a sound detection unit 500 is included in the common suppression coefficient calculation unit 60. Hereinafter, the detailed operation will be explained with this difference at a center.

The second embodiment shown in FIG. 19 includes the sound detection unit 500 for detecting the sound upon receipt of an output of the spectral gain calculation unit 200. It is widely known that the spectral gain, being the output of the spectral gain calculation unit 200, becomes large when the SNR is high, and, becomes small when the SNR is low. As a rule, employing the spectral gain makes it possible to detect the sound section because the high SNR is equivalent to the sound section, and the low SNR is equivalent to the noise section. Information of the detected sound section is conveyed to the mixture unit 100. It is also possible to previously decide a plurality of continuous or discrete representative values expressing sound-section likelihood and to employ them as information of the sound section.

Figure 20:
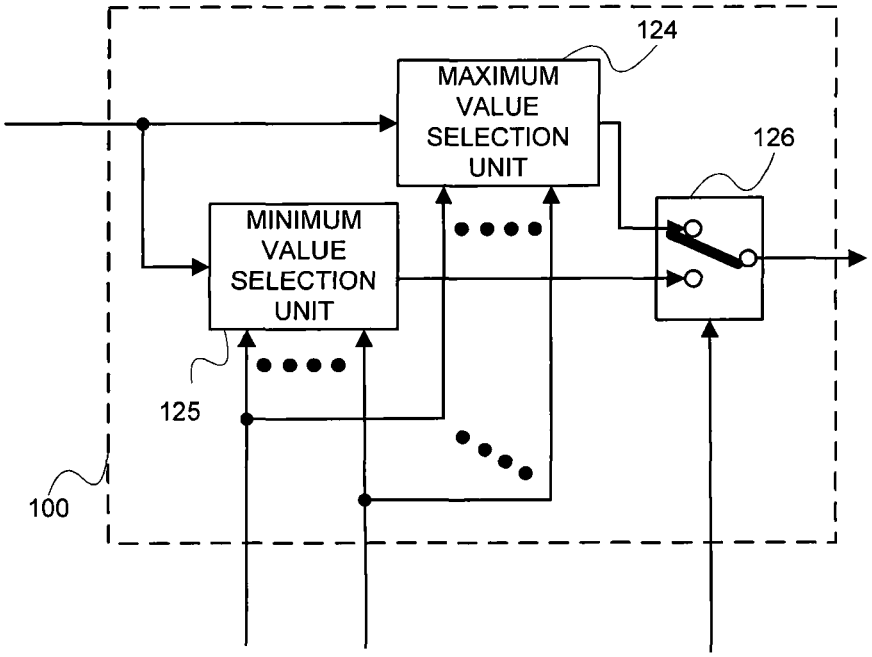
FIG. 20 is a block diagram illustrating a fourth configuration of the mixture unit.

A fourth example of the mixture unit 100 is shown in FIG. 20. The mixture unit 100 includes a maximum value selection unit 124, a minimum value selection unit 125, and a switch 126. The mixture unit 100 selects at least one power spectrum in each of the sound section and the noise section, which differ from each other, from among the power spectrums of a plurality of the inputted degraded sounds, and outputs its result. The power spectrums of a plurality of the inputted degraded sounds are supplied to the maximum value selection unit 124 and the minimum value selection unit 125. The maximum value selection unit 124 selects and outputs the power spectrum having the maximum value from among the inputted ones. The minimum value selection unit 125 selects and outputs the power spectrum having the minimum value from among the inputted ones. Thus, the maximum value, out of a plurality of the values of the power spectrums of the degraded sounds, is obtained in the output of the maximum value selection unit 124, and the minimum value is obtained in the output of the minimum value selection unit 125. The output of the maximum value selection unit 124 and the output of the minimum value selection unit 125 are conveyed to the switch 126. The switch 126 selects either of the signal conveyed from the maximum value selection unit 124 or the signal conveyed from the minimum value selection unit 125, and outputs it. The switch 126 is controlled with the signal from the sound detection unit 500 of FIG. 19. With this, the maximum value or the minimum value of the power spectrum of the inputted degraded sound can be selected and outputted responding to the sound section or the noise section. Making a configuration so that the maximum value is selected and outputted in the sound section and the minimum value is selected and outputted in the noise section enables the distortion in the sound section to be reduced, and the residual noise in the noise section to be reduced, which enables an excellent noise suppression effect to be obtained. Additionally, as explained above, when the representative value is decided so as to express the sound-section likelihood, the switch 126 can be also configured to include a function of mixing and outputting two inputs responding to the sound-section likelihood instead of a function of simply switching the operation. Assuming such a configuration enables a more refined and continuous transition between the sound section and the noise section, which contributes to an enhancement in the sound quality and the sound image positioning.

Figure 21:
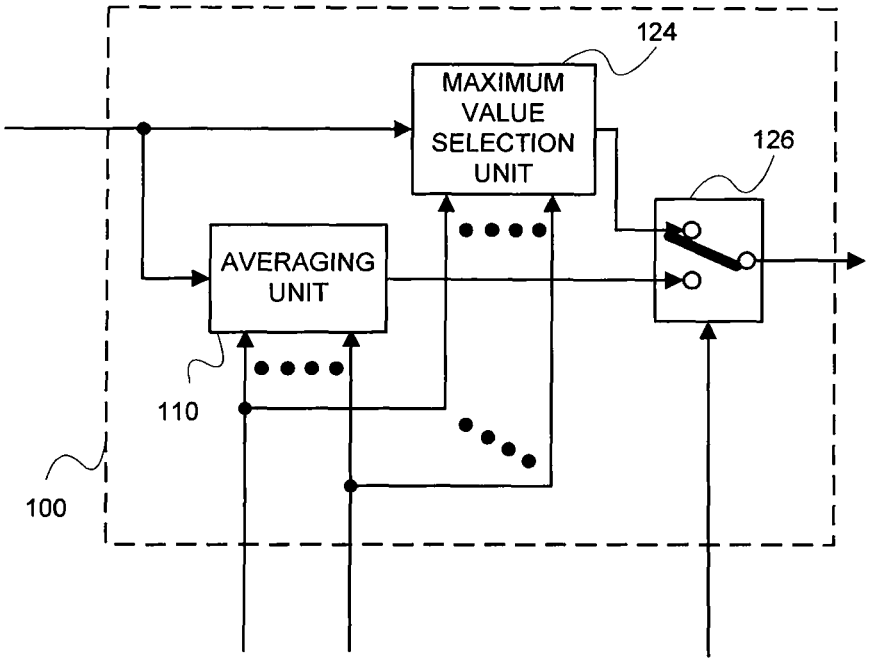
FIG. 21 is a block diagram illustrating a fifth configuration of the mixture unit.

A fifth example of the mixture unit 100 is shown in FIG. 21. The mixture unit 100 includes a maximum value selection unit 124, an averaging unit 110, and a switch 126. Upon comparing the fifth example of the mixture unit 100 with the fourth example of the mixture unit 100 shown in FIG. 20, it can be seen that the minimum value selection unit has been replaced with the averaging unit. That is, in the fifth example of the mixture unit 100, the maximum value or the average value of the power spectrum of the inputted degraded sound can be selected and outputted responding to the sound section or the noise section. Making a configuration so that the maximum value is selected and outputted in the sound section and the average value in the noise section enables the distortion to be reduced in the sound section, and the residual noise to be enlarged in the noise section as compared with the fourth example of the mixture unit 100. In this case, a level difference between the residual noise and the emphasized sound becomes small, thereby enabling a noise suppression effect, which is excellent in continuity, to be obtained.

Figure 22:
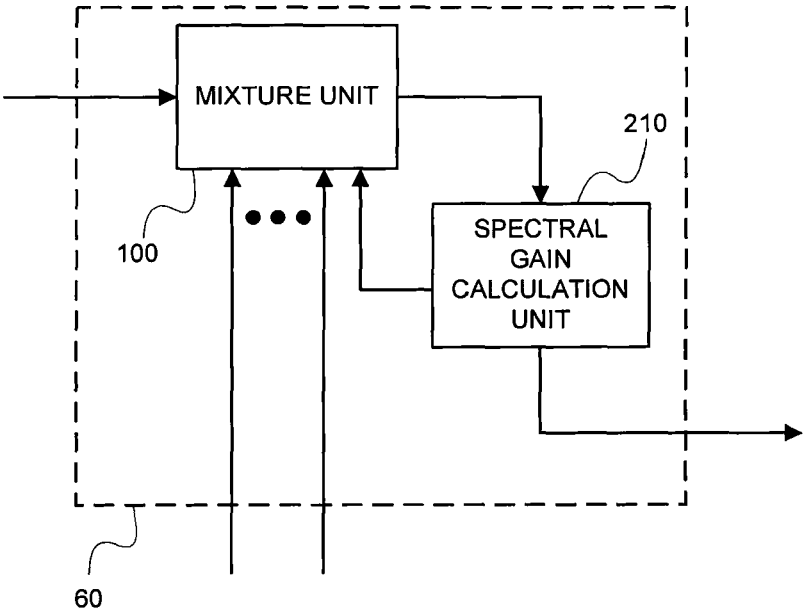
FIG. 22 is a block diagram illustrating a third embodiment of the present invention.

FIG. 22 is a block diagram illustrating the third embodiment of the present invention. FIG. 22 is identical to FIG. 19 signifying the second embodiment except for a point that the spectral gain calculation unit 200 has been replaced with a spectral gain calculation unit 210 in the common suppression coefficient calculation unit 60. Hereinafter, the detailed operation will be explained with this difference at a center.

Figure 23:
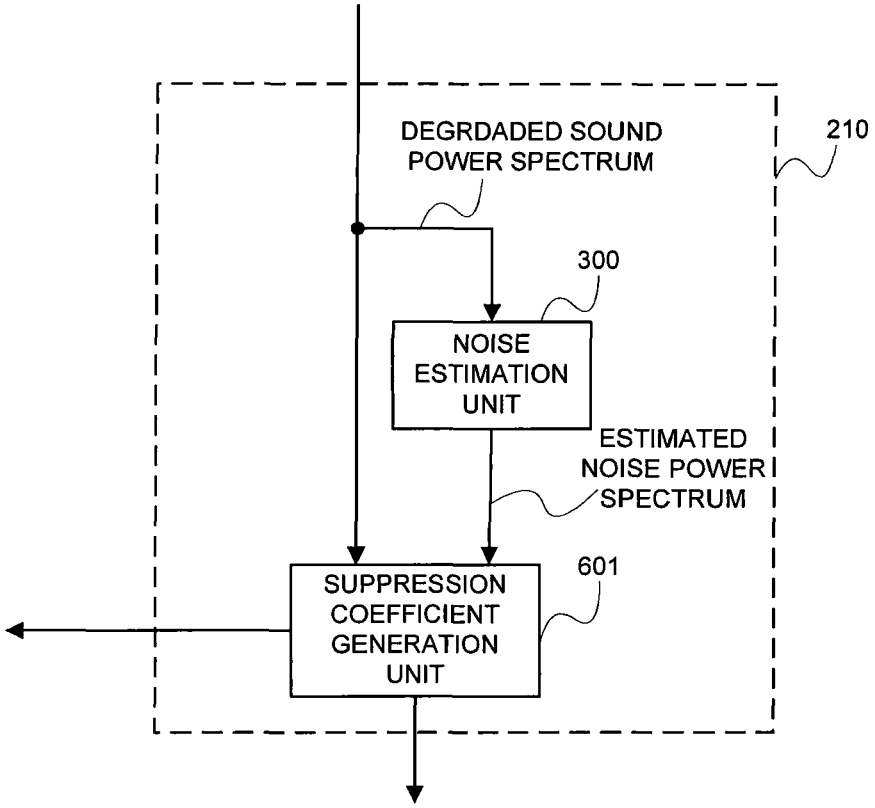
FIG. 23 is a block diagram illustrating a configuration of a spectral gain calculation unit being included in FIG. 22.

The spectral gain calculation unit 210 detects the sound, and conveys information, which enables the sound section to be distinguished from the noise section, to the mixture unit 100. FIG. 23 is a block diagram illustrating a configuration of the spectral gain calculation unit 210. Comparison thereof with FIG. 4, being a block diagram illustrating a configuration of the spectral gain calculation unit 200, demonstrates that the suppression coefficient generation unit 600 has been replaced with a suppression coefficient generation unit 601. The suppression coefficient generation unit 601, which differs from the suppression coefficient generation unit 600, outputs information as well that enables the sound section to be distinguished from the noise section.

Figure 24:
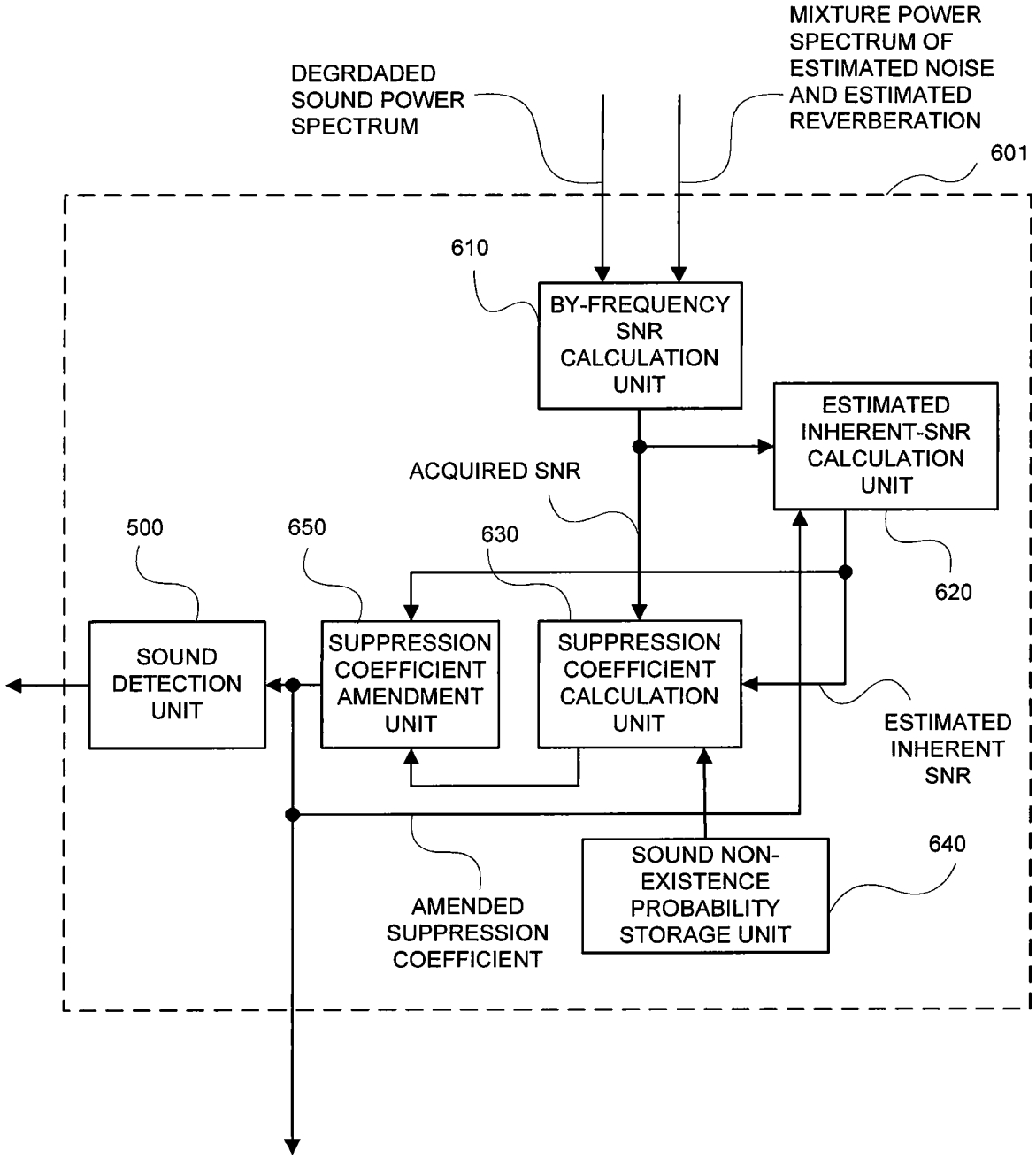
FIG. 24 is a block diagram illustrating a configuration of a suppression coefficient generation unit being included in FIG. 23.

FIG. 24 is a block diagram illustrating a configuration of the suppression coefficient generation unit 601. A point in which the suppression coefficient generation unit 601 differs from the suppression coefficient generation unit 600 shown in FIG. 12 is to include a sound detection unit 500 for outputting information as well that enables the sound section to be distinguished from the noise section with the amended suppression coefficient defined as an input. An operation of the sound detection unit 500 was already explained by employing FIG. 19, so the explanation herein is omitted.

Figure 25:
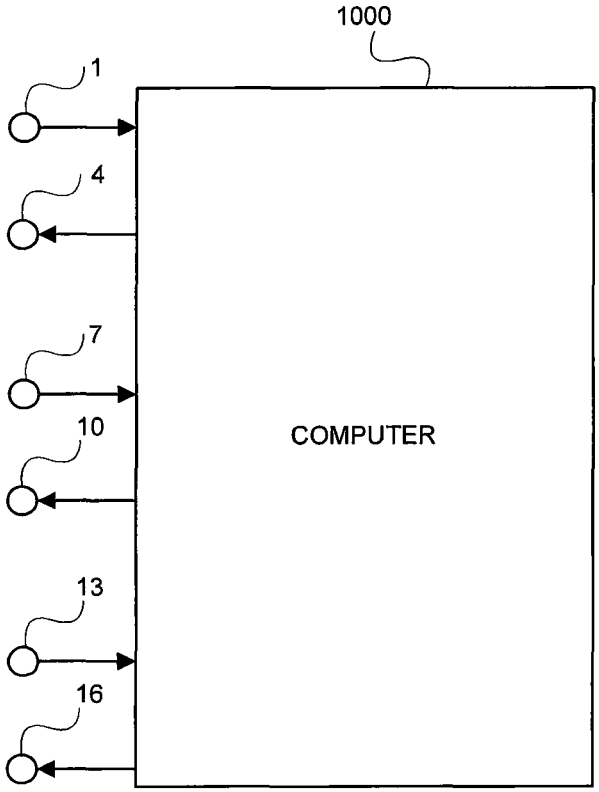
FIG. 25 is a block diagram of a noise suppression device based upon the fourth embodiment of the present invention.

FIG. 25 is a block diagram of the noise suppression device based upon the fourth embodiment of the present invention. The fourth embodiment of the present invention is configured of a computer (central processing unit; processor; data processing device) 1000 that operates under control of a program, input terminal 1, 7, and 13, and output terminals 4, 10, and 16. The computer 1000 includes conversion units 2, 8, and 14, inverse conversion units 3, 9, and 15, a common suppression coefficient calculation unit 60, and multipliers 5, 11, and 17.

The degraded sounds supplied to the input terminal 1, 7, and 13 are supplied to the conversion units 2, 8, and 14 within the computer 1000, and converted into a frequency region signal, respectively. The degraded sound frequency power spectrums obtained by converting respective input signals by the conversion units 2, 8, and 14 are supplied to the multipliers 5, 11, and 17, respectively, and simultaneously therewith, are all supplied to the common suppression coefficient calculation unit 60. Degraded sound frequency phase spectrums are supplied to the inverse conversion units 3, 9, and 15, respectively. The common suppression coefficient calculation unit 60 obtains the suppression coefficient common to all of the input signals, and conveys it to the multipliers 5, 11, and 17. The multipliers 5, 11, and 17 obtain a product of the degraded sound frequency power spectrum supplied from the conversion units 2, 8, and 14 and the common suppression coefficient, and convey it to the inverse conversion units 3, 9, and 15, respectively. The inverse conversion units 3, 9, and 15 generate time region signals by employing signals conveyed from the multipliers 5, 11, and 17 and the degraded sound frequency phase spectrums, and supplies them to the output terminals 4, 10, and 16, respectively.

In each embodiment so far, an example of obtaining one mixture signal by averaging a plurality of the input signals, or selecting the signals, and obtaining the common suppression coefficient by employing this mixture signal was explained. It is evident that, in respective operations of the averaging or the selection, by individually averaging respective input signals, then performing the operation of the selection, furthermore comparing the pre-decided threshold with the input signal or the averaged input signal, and then defining only the signal having exceeded the threshold as a target of the operation of the selection, the similar effect is obtained. Further, as an additional effect, the point can be listed of excluding the input signal that is almost soundless, thereby to prevent a bias that would exert a bad influence upon a result from occurring.

While all of the embodiments were explained so far on the assumption that the minimum square average short-time spectrum amplitude technique was employed as a technique of suppressing the noise, the other methods as well are applicable. As an example of such a method, there exit the Wiener filtering method disclosed in Non-patent document 4 (PROCEEDING OF THE IEEE, Vol. 67. No. 12, pp. 1586 to 1604, December, 1979) and the spectrum subtraction method disclosed in Non-patent document 5 (IEEE TRANSACTIONS ON ACOUSTICS, SPEECH, AND SIGNAL PROCESSING, Vol. 27. No. 2, pp. 113 to 120, April, 1979), and explanation of these detailed configuration examples is omitted.

The invention claimed is:

1. A noise suppression method to suppress a noise which coexists with and is uncorrelated with a desired signal in an input signal:

upon receipt of input signals in a plurality of channels, obtaining a weighted sum of said input signals as $w_0X_0(m)+w_1X_1(m)+\ldots+w_MX_M(m)$, wherein $X_0(m)$, $X_1(m)$, . . . , $X_M(m)$ are power spectrum of the input signals in the plurality of channels, the weighted sum representing an average;

estimating a value of said noise contained in said weighted sum to obtain a noise estimate;

settling a suppression degree for suppressing noise being included in said weighted sum based on said weighted sum, said noise estimate, an inherent signal-to-noise ratio (SNR), and a predetermined suppression degree, wherein said inherent SNR is calculated based on said noise estimate;

suppressing said noise being included in said input signals by employing said suppression degree on said input signals in common; and setting noise-suppressed signals as outputs.

2. A noise suppression method according to claim 1, characterized in expressing said common suppression degree with a spectral gain, and multiplying said plurality of said input signals by the above spectral gain, thereby to suppress noise being included in said plurality of said input signals.

3. A noise suppression device to suppress a noise which coexists with and is uncorrelated with a desired signal in an input signal, characterized in comprising:

a mixer for, upon receipt of input signals in a plurality of channels, obtaining a weighted sum of said input signals $w_0X_0(m)+w_1X_1(m)+\ldots+w_MX_M(m)$, wherein $X_0(m)$, $X_1(m)$, . . . , $X_M(m)$ are power spectrum of the input signals in the plurality of channels, the weighted sum representing an average;

estimator for estimating a value of said noise contained in said weighted sum to obtain a noise estimate;

a gain calculator for settling a suppression degree for suppressing noise being included in said weighted sum based on said weighted sum, said noise estimate, an inherent signal-to-noise ratio (SNR), and a predetermined suppression degree, wherein said inherent SNR is calculated based on said noise estimate;

a multiplier for suppressing said noise being included in said input signals by employing said suppression degree on said input signals in common; and terminals for setting noise-suppressed signals as outputs.

4. A non-transitory computer readable storage medium storing a noise suppression program to suppress a noise which coexists with and is uncorrelated with a desired signal in an input signal, for causing a computer to execute the processes of:

upon receipt of input signals in a plurality of channels, obtaining a weighted sum of said input signals as $w_0X_0(m)+w_1X_1(m)+\ldots+w_MX_M(m)$, wherein $X_0(m)$, $X_1(m)$, . . . , $X_M(m)$ are power spectrum of the input signals in the plurality of channels, the weighted sum representing an average;

estimating a value of said noise contained in said weighted sum to obtain a noise estimate;

settling a suppression degree for suppressing noise being included in said weighted sum based on said weighted sum, said noise estimate, an inherent signal-to-noise ratio (SNR), and a predetermined suppression degree, wherein said inherent NSR is calculated based on said noise estimate;

suppressing said noise being included in said input signals by employing said suppression degree on said input signals in common; and setting noise-suppressed signals as outputs.

* * * * *